US010870470B2

(12) United States Patent
Ocklenburg et al.

(10) Patent No.: US 10,870,470 B2
(45) Date of Patent: Dec. 22, 2020

(54) VALVE SYSTEM FOR A BREATHING AID, MOUTHPIECE SYSTEM FOR A BREATHING AID, SNORKLING TUBE FOR A BREATHING AID, AND BREATHING AID FOR SWIMMERS

(71) Applicant: AMEO SPORTS GMBH, Tutzing (DE)

(72) Inventors: Matthias Ocklenburg, Darmstadt (DE); Jan Von Hofacker, Tutzing (DE); Andreas Neugebauer, Starnberg (DE); Reinhard Misterek, Dortmund (DE)

(73) Assignee: AMEO SPORTS GMBH, Tutzing (DE)

( * ) Notice: Subject to any disclaimer, the term of this patent is extended or adjusted under 35 U.S.C. 154(b) by 290 days.

(21) Appl. No.: 15/538,555

(22) PCT Filed: Dec. 22, 2015

(86) PCT No.: PCT/EP2015/080899
§ 371 (c)(1),
(2) Date: Jun. 21, 2017

(87) PCT Pub. No.: WO2016/102522
PCT Pub. Date: Jun. 30, 2016

(65) Prior Publication Data

US 2018/0001979 A1 Jan. 4, 2018

(30) Foreign Application Priority Data

| | | |
|---|---|---|
| Dec. 22, 2014 | (DE) | 10 2014 226 778 |
| Jan. 23, 2015 | (DE) | 10 2015 100 961 |
| Jun. 3, 2015 | (DE) | 10 2015 210 273 |

(51) Int. Cl.
*B63C 11/18* (2006.01)
*B63C 11/20* (2006.01)

(52) U.S. Cl.
CPC ..... *B63C 11/186* (2013.01); *B63C 11/205* (2013.01); *B63C 2011/182* (2013.01)

(58) Field of Classification Search
CPC ..... B63C 11/00; B63C 11/12; B63C 11/16; B63C 11/186; B63C 11/205; B63C 11/2209; B63C 11/2227; B63C 2011/182
See application file for complete search history.

(56) References Cited

U.S. PATENT DOCUMENTS

| | | | | |
|---|---|---|---|---|
| 46,902 A | 3/1865 | Hawkins | ..... | 128/201.11 |
| 1,210,939 A | 1/1917 | Hilgers | ..... | 128/201.11 |

(Continued)

FOREIGN PATENT DOCUMENTS

| | | | | |
|---|---|---|---|---|
| CN | 203 497 157 | 3/2014 | ..... | B63C 11/20 |
| DE | 102015122503 | 6/2016 | ..... | B63C 11/16 |

(Continued)

OTHER PUBLICATIONS

Notification Concerning Transmittal of International Preliminary Report on Patentability (Chapter I of the Patent Cooperation Treaty), in English, dated Jul. 6, 2017, which was issued by the International Bureau of WIPO in Applicant's corresponding international PCT application having Serial No. PCT/EP2015/080899, filed on Dec. 22, 2015.

(Continued)

*Primary Examiner* — Bradley H Philips
*Assistant Examiner* — Savannah L Gabriel
(74) *Attorney, Agent, or Firm* — Bodner & O'Rourke, LLP; Gerald T. Bodner; Christian P. Bodner

(57) ABSTRACT

The invention relates to a valve system (10) for a breathing aid for swimmers, in particular for an inhalation valve, comprising a valve housing (1) and a valve diaphragm (2) in the valve housing (1); in a contact zone (3) preferably located in a central area of the valve diaphragm (2), the valve (Continued)

Figure 1A:
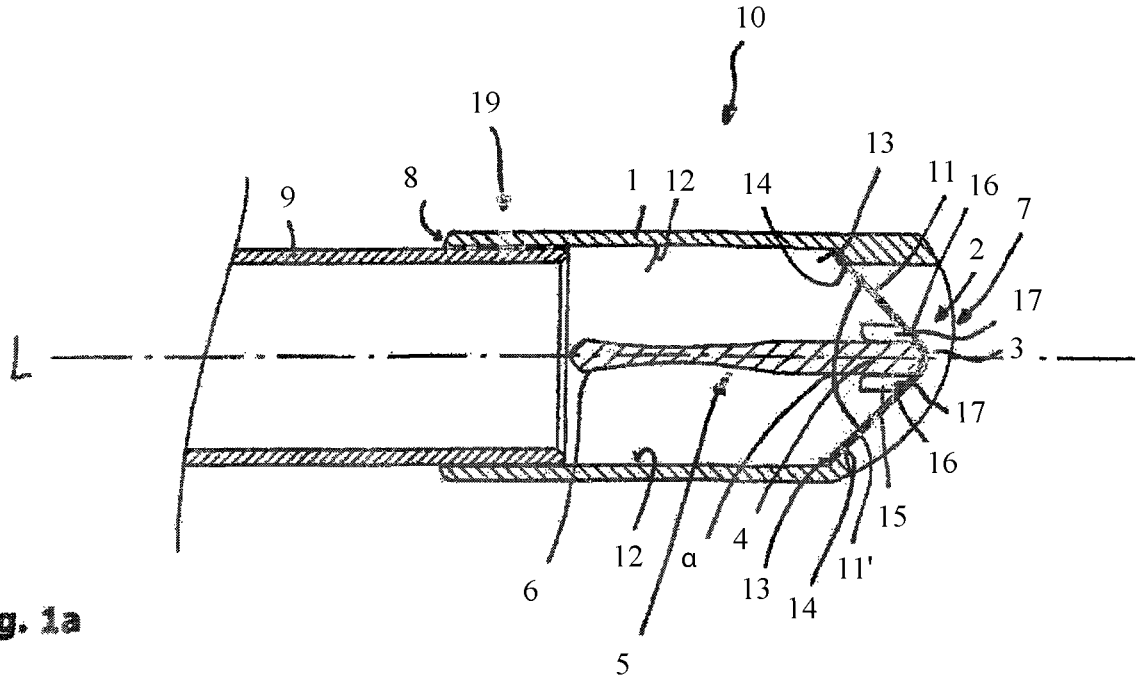

diaphragm (2) is disposed on a first end (4) of a fastening element (5); furthermore, from the contact zone (3), the valve diaphragm (2) runs at least partially at an angle in the direction of a second end (6) of the fastening element (5).

13 Claims, 17 Drawing Sheets

(56) References Cited

U.S. PATENT DOCUMENTS

| | | | | |
|---|---|---|---|---|
| 2,317,236 | A | 4/1943 | Wilen et al. | 106/38 |
| 3,166,083 | A * | 1/1965 | Girden | B63C 11/16 137/388 |
| 3,415,245 | A | 12/1968 | Yamamato et al. | 128/201.19 |
| 4,230,106 | A | 10/1980 | Geeslin et al. | 128/201.11 |
| 4,610,246 | A | 9/1986 | Delphia | 128/201.11 |
| 4,634,117 | A | 1/1987 | Kramer | 482/13 |
| 4,878,491 | A | 11/1989 | McGilvray, III | 128/201.11 |
| 5,485,832 | A | 1/1996 | Joffity | 128/201.11 |
| 5,518,026 | A | 5/1996 | Benjey | 137/512.15 |
| 5,671,728 | A | 9/1997 | Winefordner et al. | 128/201.11 |
| 5,697,362 | A | 12/1997 | Albrecht | 128/201.11 |
| 6,550,479 | B1 | 4/2003 | Duxbury | 128/205.27 |
| 6,820,615 | B1 | 11/2004 | Feng | 128/201.27 |
| D501,044 | S | 1/2005 | Weigner | D24/110.5 |
| 2008/0135045 | A1* | 6/2008 | Johnson | B63C 11/205 128/201.11 |
| 2009/0038058 | A1 | 2/2009 | Carroll | 2/436 |
| 2009/0172935 | A1* | 7/2009 | Anderson | B63C 11/202 29/402.08 |
| 2011/0168173 | A1 | 7/2011 | Shieh | 128/201.11 |
| 2011/0240030 | A1* | 10/2011 | Ho | A61M 16/06 128/206.21 |
| 2013/0133648 | A1* | 5/2013 | Beach | A62B 9/06 128/202.27 |
| 2014/0331997 | A1* | 11/2014 | Weigner | B63C 11/205 128/201.11 |
| 2015/0239537 | A1 | 8/2015 | Calvillo | 128/201.11 |

FOREIGN PATENT DOCUMENTS

| | | | |
|---|---|---|---|
| EP | 0 925 800 | 6/1999 | A61M 16/00 |
| EP | 002728261-0001 | 7/2015 | 21/2 |
| EP | 002728261-0002 | 7/2015 | 21/2 |
| EP | 002728261-0003 | 7/2015 | 21/2 |
| EP | 002728261-0004 | 7/2015 | 21/2 |
| EP | 002728261-0005 | 7/2015 | 21/2 |
| EP | 002728261-0006 | 7/2015 | 21/2 |
| EP | 002728261-0007 | 7/2015 | 21/2 |
| EP | 002728261-0008 | 7/2015 | 21/2 |
| EP | 002728261-0009 | 7/2015 | 21/2 |
| EP | 002728261-0010 | 7/2015 | 21/2 |
| EP | 002728261-0011 | 7/2015 | 21/2 |
| EP | 002728261-0012 | 7/2015 | 21/2 |
| EP | 002728261-0013 | 7/2015 | 21/2 |
| EP | 002728261-0014 | 7/2015 | 21/2 |
| EP | 002728261-0015 | 7/2015 | 21/2 |
| EP | 002728261-0016 | 7/2015 | 21/2 |
| EP | 002728261-0017 | 7/2015 | 21/2 |
| EP | 002728261-0018 | 7/2015 | 21/2 |
| EP | 002728261-0019 | 7/2015 | 21/2 |
| EP | 002728261-0020 | 7/2015 | 21/2 |
| EP | 002728261-0021 | 7/2015 | 21/2 |
| EP | 002728261-0022 | 7/2015 | 21/2 |
| WO | WO 2013/167697 | 11/2013 | A42B 1/12 |

OTHER PUBLICATIONS

English translation of the International Preliminary Report on Patentability (Chapter I of the Patent Cooperation Treaty), dated Jun. 27, 2017, which was issued by the International Bureau of WIPO in Applicant's corresponding international PCT application having Serial No. PCT/EP2015/080899, filed on Dec. 22, 2015.

Written Opinion of the International Searching Authority, in English, dated Jun. 27, 2016, which was issued by the International Bureau of WIPO in Applicant's corresponding international PCT application having Serial No. PCT/EP2015/080899, filed on Dec. 22, 2015.

International Search Report, in English, dated Jun. 27, 2016, which was issued by the International Bureau of WIPO in Applicant's corresponding international PCT application having Serial No. PCT/EP2015/080899, filed on Dec. 22, 2015.

* cited by examiner

VALVE SYSTEM FOR A BREATHING AID, MOUTHPIECE SYSTEM FOR A BREATHING AID, SNORKLING TUBE FOR A BREATHING AID, AND BREATHING AID FOR SWIMMERS

The invention relates to a valve system for a breathing aid for swimmers, in particular for an inhalation valve, according to the patent claims. Moreover, the invention relates to a mouthpiece system for a breathing aid according to the patent claims. Furthermore, the invention relates to a snorkeling tube for a breathing aid for swimmers according to the patent claims. The invention further relates to a breathing aid for swimmers, comprising at least two snorkeling tubes, according to the patent claims. Furthermore, the invention relates to a breathing aid for swimmers, comprising at least one snorkeling tube, according to the patent claims.

Numerous valves or valve systems for snorkels or breathing aids for swimmers are known from prior art. The initial counter-pressure or noticeable resistance in inhaling, even though only marginal, is often described as a disadvantage in known valve systems or inhalation valves. Furthermore, it has been the case thus far that when performing flip turns, water may enter snorkels having known valve systems. Water in particular enters through the inhalation valves. This leads to corresponding panic states for a swimmer.

Starting from this prior art, it is firstly a task of the present invention to propose an enhanced valve system for a breathing aid for swimmers so that the initial counter-pressures or resistances in inhaling can no longer occur and, in addition, flip turns can be made with the valve system.

Furthermore, mouthpiece systems or mouthpieces for breathing aids for swimmers are known from prior art, the mouthpiece systems hitherto being designed such that exhaled air rises in front of the swimmer's eyes in the form of bubbles. This leads to impediments when swimming. Moreover, the swimmer may also notice a corresponding resistance when exhaling. Furthermore, mouthpiece systems known thus far have the disadvantage for flip turns not being feasible with the same. Thus far, water will enter into known mouthpiece systems during such flip turns.

Starting from this prior art, it is a task of the present invention to enhance a mouthpiece system for a breathing aid for swimmers such that flip turns can be made. Moreover, the mouthpiece system should be enhanced such that exhaled air is no longer swirled up in front of the head, in particular the eyes of a swimmer.

Snorkeling tubes for breathing aids for swimmers are known to date from prior art which tubes have a standard size. These snorkeling tubes are used for children, women as well as men having different body dimensions. This may lead to impediments when swimming since these snorkeling tubes are not adaptable to a head fastening system, for example.

Starting from this prior art, it is the task of the present invention to propose an enhanced snorkeling tube for a breathing aid for swimmers which snorkeling tube can be used individually.

Hitherto known snorkeling tubes or breathing aids for swimmers are fixed to the head of a swimmer by means of rubber bands. Such rubber bands tend to break within a short time of application when being correspondingly used in seawater or chlorinated water. Moreover, the wearing comfort is very restricted. Due to the known fastening systems, the mouthpieces are pressed against the teeth and the palate of a swimmer, respectively, so that the swimmer feels pain already within a very short time of wear.

Due to the disadvantages associated with the known prior art, it is consequently a task of the present invention to enhance a snorkeling tube for a breathing aid for swimmers and a breathing aid for swimmers, respectively, as well as a method for putting on a breathing aid for swimmers such that the wearing comfort for the swimmer is improved and the putting on of such a breathing aid is moreover simplified.

It is known from prior art to fix swimming goggles and/or diving goggles on the swimmer's head by means of rubber bands. It appears, however, that such rubber bands tend to break already after a short period of use due to the use in seawater and/or chlorinated water. As a usual result, not only the head band of the diving goggles is exchanged but also the swimming goggles and/or diving goggles as a whole are replaced by the swimmer. This leads to a considerable cost burden.

Starting from this prior art, it is a further task of the present invention to propose swimming goggles and/or diving goggles having an enhanced head attachment system.

According to the invention, these tasks are solved with respect to the valve system for a breathing aid by the subject matter of the patent claims, with respect to the mouthpiece system for a breathing aid by the subject matter of the patent claims, with respect to the snorkeling tube by the subject matter of the patent claims, with respect to the breathing aid for swimmers by the subject matter of the patent claims, and with respect to a breathing aid for swimmers, comprising at least one snorkeling tube, according to the patent claims.

The cited tasks are solved with respect to a snorkeling tube by the subject matter of exemplary embodiment 1 or 6, with respect to a method for putting on a breathing aid for swimmers by exemplary embodiment 9, and with respect to swimming goggles and/or diving goggles having a head attachment system by the subject matter of exemplary embodiment 12.

Advantageous and appropriate configurations of the valve system according to the invention and/or the mouthpiece system according to the invention and/or the snorkeling tube according to the invention and/or the breathing aid according to the invention are indicated in the dependent claims.

The valve system according to the invention for a breathing aid for swimmers, in particular an inhalation valve, comprises a valve housing and a valve diaphragm disposed in the valve housing, with the valve diaphragm being disposed in a contacting section, that is preferably formed in a central area of the valve diaphragm, at a first end of a fastening element, with the valve diaphragm, from the contacting section, being formed at least in sections to be at an angle in the direction of a second end of the fastening element.

Accordingly, a valve diaphragm made of a thin plastic material, for example, is disposed in a valve housing. A valve diaphragm comprises a cross-section of a kind that is adapted to the inner cross-section of a snorkeling tube and/or a valve housing. A corresponding adaptation of the valve diaphragm's cross-section to the valve housing's cross-section allows a tight closure to be guaranteed within the valve housing. The valve diaphragm is configured to be circular or elliptical or oval, for example.

The valve diaphragm comprises a contacting section which is in turn arranged at a first end of a fastening element. The arranging may be understood both as fastening the contacting section at the fastening element's first end and as merely placing the contacting section in close proximity to the fastening element's first end. It is conceivable for the contacting section to be arranged in extension of the fastening element's first end and to merely comprise a slight distance from the fastening element's first end.

The contacting section which is formed preferably in a central area of the valve diaphragm, at least in a longitudinal cur view through the valve system, is arranged in extension to the fastening element's first end. The contacting section may be formed both as a contacting point and as a contacting surface. If the valve diaphragm is configured to be circular, the contacting section or the contacting point will be the valve diaphragm's center. Also in a configuration as an oval or elliptical valve diaphragm, the contacting section will be formed preferably in the area of the geometrical center of the valve diaphragm. As seen from the contacting section, the valve diaphragm is formed at least in sections to be at an angle in the direction of the fastening element's second end. The fastening element's second end preferably may be referred to as a second longitudinal end or is the second end following the fastening element's first end in the air flow direction.

In other words, the valve diaphragm is not disposed to be flat within the valve housing but at an angle or angled. Due to the valve diaphragm's angled design, inhaling is considerably facilitated since an initial resistance or counter-pressure is not noticeable when inhaling air.

The described fastening element may be of a tappet-like design, for example. Furthermore, it is conceivable for the fastening element to be formed as a cylinder and/or a different rotationally symmetrical element.

It is moreover possible for the fastening element to be formed as a plate-like or plate-shaped element. The fastening element's longitudinal extension preferably proceeds in the air flow direction. The fastening element is preferably longer than wide and/or thick. The fastening element may comprise webs and/or recesses extending in the longitudinal direction or air flow direction. Furthermore, the fastening element's first end may be formed to be at an angle. Further, an angled guiding element may be formed at the fastening element's first end.

In a longitudinal cut view, i.e. a cut view extending longitudinally through the valve system, the valve diaphragm comprises two valve diaphragm sections each formed to be at an angle from the contacting section to the fastening element's second end, with the valve diaphragm sections, in particular in a state of exhalation or rest, enclosing an angle of 20°-120°, in particular of 40° to 110°, in particular of 60° to 100°, in particular of 80°-95°.

In a view not assuming a longitudinal cut view could be seen that the valve diaphragm is formed to be at an angle from the contacting section to the fastening element's second end over the entire circumference.

In a state of inhalation, the mentioned angle is decreased since at least one end portion of the valve diaphragm formed to be at a maximum distance from the contacting section, is angled more toward the fastening element's second end in the state of inhalation. In a state of inhalation, the angle may comprise a value of 10-85°, in particular of 20°-70°, in particular of 30°-60°, in particular of 40°-55°.

Due to the angle's decrease in a state of inhalation, air may enter the valve system or the valve housing and flow to a mouthpiece of a breathing aid via a snorkeling tube, for example.

In an embodiment of the invention, the valve housing is formed to be sleeve-like, with a boundary surface protruding toward the inside being formed on the valve housing's internal surface. Housings of a kind comprising a valve housing wall delimiting a cavity are to be understood as sleeve-like valve housings. Conceivable are both circular cylindrical as well as configurations in terms of a skewed cylinder. A boundary surface protruding toward the inside should be understood as a boundary surface of a kind that points in the direction of the valve housing's center. The boundary surface, for instance may be formed to be oblique. That is, the boundary surface protrudes from the valve housing at an angle different from 90°.

In an embodiment of the invention, at least one end portion of the valve diaphragm which is formed to be at a maximum distance from the contacting section may rest upon the boundary surface in a state of exhalation or rest. In other words, those portions of the valve diaphragm should be understood as the valve diaphragm's end portion which form the outer portion of the valve diaphragm. In the state of exhalation or rest, at least one of these and portions rests upon the boundary surface. The boundary surface accordingly serves as a non-return protection so that the valve diaphragm remains arranged in the valve housing. In other words, the boundary surface projects beyond the valve diaphragm's outer circumference in the direction of the valve housing center.

In a particularly preferred embodiment of the invention, the boundary surface is formed over the entire inner circumference. Here, it is conceivable for the valve diaphragm to comprise an end portion over the entire circumference which is formed to be at a maximum distance from the contacting section and rests upon the boundary surface in a state of exhalation or rest.

The fastening element may be formed at the first end in a clamping portion. The clamping portion may serve to arrest the fastening element. The valve diaphragm may repose upon the clamping portion and/or be attached thereto.

Particularly preferred, the valve diaphragm rests upon at least one beveled surface of the clamping portion and/or is attached to at least one beveled surface of the clamping portion. The clamping portion's beveled surface preferably defines the valve diaphragm's angle toward the fastening element's second end. The definition of the angle relates to the angle in the state of exhalation or rest.

For decreasing the angle in a state of inhalation, the valve diaphragm's end portions are merely at an angle in the direction of the fastening element's second end. Such portions of the valve diaphragm preferably rest upon the clamping portion, in particular upon a beveled surface of the clamping portion and/or are attached there which are formed to be circumferential to the contacting section. If the valve diaphragm, for instance is formed to be circular, such surface portions of the valve diaphragm are concerned which are formed to be concentric about the contacting section and located in close proximity to the contacting section.

As an alternative or in addition, it is possible for portions of the valve diaphragm that are formed to be circumferential to the contacting section to rest upon an angled guiding element of the fastening element. It is possible for these portions to rest upon a beveled surface of the angled guiding element and/or to be attached there. The result is, for example, that the valve diaphragm adopts a desired angle already in the state of exhalation or rest. Furthermore, a further angling of the valve diaphragm's end portions in the direction of the fastening element's second end is facilitated in the state of inhalation. The user of a valve system or swimmer correspondingly requires less effort to be able to inhale a desired volume of air through the valve system.

The fastening element and/or the clamping portion may be realized as a flow divider in the valve housing. Such a flow divider facilitates the intake of air with such a valve system. Inhalation by means of a valve system according to the invention is thus facilitated.

An air-permeable cover may be formed at the valve housing's air inlet opening. The air-permeable cover comprises, for example, a plurality of strut-like elements. Coarse impurities are kept away from the vale system by means of such a cover. At the same time, air may still flow through this cover.

In a further embodiment of the invention, it is conceivable for the air-permeable cover to comprise a plurality of strut-like elements, with the strut-like elements being formed to be mutually crossing. In this case, the strut-like elements may also be called webs, wherein the webs are arranged to be flat and mutually crossing. A grid-like or grid-shaped air-permeable cover is formed.

In another further embodiment of the invention, it is possible for an air-permeable cover having a plurality of circular and/or oval and/or elliptical openings, to be formed at the valve housing's air inlet opening. It is in particular possible for the air-permeable cover to comprise such a thickness that the circular and/or oval and/or elliptical openings are realized in the form of small ducts and/or capillaries. It is possible for the air-permeable cover to comprise a curvature and/or bevel. The circular and/or oval and/or elliptical openings preferably are formed to mutually extend in parallel such that the extensions of the openings are all mutually in parallel. The size of the openings or the cross-sections of the circular and/or oval and/or elliptical openings in this case should be selected such that impurities and/or particles may not get into the valve system, on the one hand. Furthermore, the size or the cross-section of the openings should be designed such that a sufficient amount of air may get into the valve system. As a whole, a sieve-like or mesh-like air-permeable cover is formed due to the circular and/or oval and/or elliptical openings.

The air-permeable covers of the cited embodiments inter alia effect retention of impurities and/or particles. In an advantageous manner, these will not get into the valve system.

A throttling element may be formed in the valve housing for throttling the air flowing into the valve system. Such a throttling element may be formed on the inner surface of the valve housing, for example, and causes a reduced air volume to flow into the valve system. For the user of a breathing aid or a swimmer this may have the effect that only a limited inhalation volume will be provided. The inhalation volume available to the user or swimmer can therefore be controlled. This may be used as an additional training. The swimmer's endurance can thus be increased.

The throttling element may be formed as a tapering inside the valve housing, for example. The throttling element may in this case be formed as a wall of the valve housing that is reinforced or thickened in sections. The section-wise reinforcement or thickening may be formed in the valve housing for instance over the entire circumference. It is conceivable for the throttling element to be formed in one piece with the valve housing. In a further embodiment of the invention, it is possible for the throttling element to be formed as a separate or additional element or component which is connected to the valve housing or attached to the valve housing, for example. The throttling element is designed so as to produce a reduced air flow cross-section in the valve housing.

It is also possible for the throttling element to be formed centrally in the valve housing's air flow duct. A configuration similar to a flow divider is conceivable. In order to take into account requirements of different athletes or swimmers, it is conceivable for the throttling element to regulate the inhalation volume in different amounts and/or ways. It is conceivable to construct different valve systems having throttling elements of different strong actions. For each athlete or swimmer, the appropriate valve system may be selected together with the associated throttling element. It is possible to select the air resistance and/or the air volume in inhaling by means of the throttling element. A modular system enables the swimmer to select different air resistances and/or air volumes in the intake of breath by choosing between a plurality of throttling elements of different designs. Training stimuli may be set in the field of the oxygen balance and the endurance capacity. It is conceivable for the air supply to be gradually reduced during a training so that difficult constraints during swimming may be simulated.

In a further aspect of the invention, the described throttling element is not formed as a part of the valve system but as a component or element in a snorkeling tube. A throttling element may be formed in the snorkeling tube for throttling the air flowing into the snorkeling tube. Such a throttling element may be formed at the inner surface of the snorkeling tube, for example, and causes a reduced air volume to flow into the snorkeling tube. For the user of a breathing aid or a swimmer this may have the effect that only a limited inhalation volume will be provided. The inhalation volume available to the user or swimmer can therefore be controlled. This may be used as an additional training. The swimmer's endurance can thus be increased.

The throttling element may be formed as a tapering inside the snorkeling tube, for example. The throttling element may in this case be formed as a wall of the snorkeling tube that is reinforced or thickened in sections. The section-wise reinforcement or thickening may be formed in the snorkeling tube for instance over the entire inner circumference. It is conceivable for the throttling element to be formed in one piece with the snorkeling tube. In a further embodiment of the invention, it is possible for the throttling element to be formed as a separate or additional element or component which is connected to the snorkeling tube or attached to the valve housing, for example. The throttling element is designed so as to produce a reduced air flow cross-section in the snorkeling tube.

It is also possible for the throttling element to be formed centrally in the snorkeling tube's air flow duct. A configuration similar to a flow divider is conceivable. In order to take into account requirements of different athletes or swimmers, it is conceivable for the throttling element to regulate the inhalation volume in different amounts and/or ways. It is conceivable to construct different snorkeling tubes having throttling elements of different strong actions. For each athlete or swimmer, the appropriate snorkeling tube may be selected together with the associated throttling element. It is possible to select the air resistance and/or the air volume in inhaling by means of the throttling element. A modular system enables the swimmer to select different air resistances and/or air volumes in the intake of breath by choosing between a plurality of throttling elements of different designs. Training stimuli may be set in the field of the oxygen balance and the endurance capacity. It is conceivable for the air supply to be gradually reduced during a training so that difficult constraints during swimming may be simulated.

The described throttling element may be formed in addition as a component or element of the snorkeling tubes according to the invention described below.

In a further embodiment of the invention, it is conceivable for the valve system according to the invention or a different valve system to be provided in a set, with the set including several valve diaphragms having various diaphragm thicknesses. The inflow of air into the valve system, in particular the inhalation behavior of a swimmer, may thus be influenced as a function of the valve diaphragm thickness. The smaller the valve diaphragm thickness is, the easier the swimmer or user can breathe in air. If the set includes several valve diaphragms of different diaphragm thicknesses the user or swimmer can select a valve diaphragm among a plurality of valve diaphragms. Successive training units performed with a valve system having different valve diaphragm thicknesses, i.e. in particular with gradually increasing valve diaphragm thicknesses, will cause a positive training effect with respect to the user's or swimmer's lung volume and/or endurance.

In the context of the valve system according to the invention, supplementary reference is made to the following embodiments and advantages.

At an end portion of the valve housing facing away from the air inlet opening, at least one latching element and/or latching surface may be formed on the inner surface and/or the outer surface for attaching the valve system to a snorkeling tube. The valve housing of the valve system is preferably slid onto a snorkeling tube. However, it is also conceivable for the valve system's valve housing to be inserted in a snorkeling tube.

Depending on the case of application, the valve housing may thus have a diameter or cross-section which is either slightly smaller or slightly larger than the snorkeling tube's diameter or cross-section.

In a further embodiment of the invention, it is conceivable for the valve system's valve housing to be connected to a snorkeling tube in a merely clamping manner. Concerning this, it is conceivable for the valve housing's inner cross-section to be slightly smaller than the snorkeling tube's outer cross-section so that the valve housing can be slid onto the snorkeling tube. Alternatively, it is conceivable for the valve housing's outer cross-section to be slightly smaller than the snorkeling tube's inner cross-section so that the valve system's valve housing can be inserted in the snorkeling tube in a clamping manner.

It is possible for the valve housing of the valve system according to the invention to be formed in multiple parts and comprises valve housing sections that are interconnected, in particular telescoped and/or slid on.

It is in particular conceivable for the valve housing to comprise a plurality of sleeve-like valve housing sections. The sleeve-like valve housing parts or valve housing sections may be telescoped and/or on one another. The inner diameters and outer diameters of the valve housing sections are matched to one another such that the valve housing sections may be telescoped and/or slid on one another and a clamping connection is established between the valve housing sections.

It is furthermore possible for a valve housing section to comprise an in particular annular bulge on the outer surface. Such a bulge, for instance can prevent a first valve housing section from undesirably slipping into a second valve housing section. A a bulge, in particular an annular bulge on the outer surface of the valve housing section, consequently forms a step or step-like contour on the outer surface.

At least one valve housing section, preferably all of the valve housing sections may comprise latching means so that the single valve housing sections can be connected to one another. Conceivable are in this case burl-shaped latching means, for example, which may latch or engage into recess-like latching means of a further valve housing section.

The explanations relating to an optional bulge and/or with respect to the latching means apply as well in the context of a one-piece valve housing. An additional covering cap may be slid onto such a valve housing.

An independent aspect of the invention relates to a mouthpiece system for a breathing aid for swimmers, comprising a mouthpiece, a system housing, an exhalation valve and an air outlet opening, with the air outlet opening being covered by a diffusor extension comprising a diffusor plate, and the diffusor plate having a plurality of openings.

Hereinafter, that part of the mouthpiece system is considered as a mouthpiece that is introduced at least in part into the mouth by a swimmer. A mouthpiece typically comprises a bite tray or a dental support plate. At least the upper lip of a swimmer will preferably be sealed by means of a sealing pad of the mouthpiece.

The system housing serves the purpose of attaching the mouthpiece, on the one hand, and furthermore comprises the exhalation valve. The exhalation valve may be a flutter valve, for example. Moreover, the mouthpiece system's system housing preferably serves to receive the end of a snorkeling tube. Inside the system housing, an air outlet opening downstream of an exhalation valve is formed, with the opening being covered by a diffusor extension. The diffusor extension comprises a diffusor plate which in turn exhibits a plurality of in particular circular and/or oval and/or elliptical openings. In other words, a hole pattern is formed on the diffusor plate.

In an embodiment of the invention, the mouthpiece may be firmly locked onto the system housing. It is moreover conceivable for the mouthpiece to be locked onto the system housing in an exchangeable manner so that, after corresponding wear and tear, it can be exchanged. Moreover, when used by several persons, the mouthpiece can be exchanged hygienically if it is arranged to be exchangeable in the system housing.

The diffusor plate which is contacted by the diffusor extension has an inner surface facing the exhalation valve, and an outer surface facing away from the exhalation valve. The openings in the diffusor plate extend from the inner surface to the outer surface at an angle of 5° to 89°, in particular of 40° to 85°, in particular of 50° to 80°, in particular of 60° to 76°. The angle indication should be interpreted such that the normal to the inner surface form a first reference line, and the opening axis in a longitudinal cut view through the diffusor plate forms a second reference line so that the indicated angle extends between the two lines.

The openings in the diffusor plate may be formed to be circular and/or oval and/or elliptical. The diffusor plate preferably has such a thickness or material thickness that the openings in the diffusor plate form short ducts or short capillaries. The diffusor plate may have a sieve-like or mesh-like structure.

In the state of use, the angle extends forward to the bottom, i.e. in the direction of the swimmer's chin. As a result, the exiting air will not be deviated in the direction of the face but backward, i.e. in the direction of the neck. Consequently, a development or formation of air bubbles in front of the swimmer's face is not created. Moreover, such an angle design does not entail water from flowing into the mouthpiece when performing a flip turn.

The described angle, at which the openings extend from the inner surface to the outer surface, may be adaptable individually to the swimmer, in particular to the swimmer's lung volume and/or capacity and/or preferences.

For this purpose, it is advantageous for the diffusor plate and/or the diffusor extension to be mounted on the system housing to be exchangeable, in particular by means of latching and/or snap connections. According to the swimmer's training level or physical condition, a diffusor plate may be installed in the mouthpiece system to be exchangeable, with the different diffusor plates differing with respect to the angle.

The mouthpiece system preferably comprises a mouthpiece with a bite tray or a dental support plate. A cross-section through the mouthpiece system according to the invention, when viewed form the side, shows an angle that is formed between an opening axis of an opening of the diffusor plate and the bite tray or dental support plate. This angle is between 90 and 40°, in particular between 80 and 50°, in particular between 75 and 65°. Based on this angle, the exiting behavior of the air pressed or blown through the diffusor plate is further defined. Such an adjusted angle moreover contributes to create a pleasant mouth wear feeling with respect to the mouthpiece system.

It is furthermore conceivable for the system housing to comprise at least one lateral opening in which a snorkeling tube is mounted to be rotatable. The mouthpiece system is therefore preferably not fixedly connected to the snorkeling tube, rather it is advantageous for the snorkeling tube to be mounted to be rotatable inside the mouthpiece system.

In a further embodiment of the invention it is conceivable for the system housing to have two opposing lateral openings, in each of which a snorkeling tube is mounted to be rotatable.

It is conceivable for a flange surface of a snorkeling tube that is preferably formed to be of a circular ring or elliptical ring shape is arranged to be rotatable or may be arranged to be rotatable in the mouthpiece system's system housing at an inner surface delimiting the lateral opening. Due to such an arrangement, the mouthpiece system and/or the snorkeling tube may be adapted individually to the head of the respective swimmer in terms of the respective positioning.

A further independent aspect of the invention relates to a snorkeling tube for a breathing aid for swimmers, wherein at a snorkeling tube section facing an air inlet opening, at least one weakening contour, preferably a plurality of spaced apart weakening contours is formed such that the length of the snorkeling tube is formed to be adaptable by severing a weakening contour.

Depending on the swimmer's demand, a certain part of the snorkeling tube section which is facing the air inlet opening may thus be severed from the rest of the snorkeling tube. The snorkeling tube accordingly is adaptable in terms of its length. The weakening contours preferably extend around the snorkeling tube section over the entire circumference. For example, the weakening contours are formed to be circular or oval or elliptical. The weakening contour's design with respect to shape is preferably adapted to the snorkeling tube section's existing cross-section. If the snorkeling tube has a circular cross-section, for example, it is advantageous for the weakening contours to be also of a circular design over the entire circumference.

Such contours are to be understood as weakening contours which produce a decrease in material thickness. It is furthermore conceivable for the weakening contours to have recesses that are formed to be spaced apart from one another.

In a first embodiment of the invention, it is conceivable for the weakening contour to be formed such that by laterally twisting or kinking the respective weakening contour, a severing of the snorkeling tube length may be effected.

In another embodiment of the invention, it is conceivable for the weakening contour to facilitate mechanical severing, for instance by means of a saw and/or scissors and/or a knife.

It is furthermore possible for a plurality of markings that are spaced apart from one another to be formed on the snorkeling tube section, with the snorkeling tube length being adjustable by means of the markings. The markings thus serve the purpose of severing the snorkeling tube section at a defined location, for example. To this end, dimension indices may be formed relating e.g. to the head circumference of a swimmer. The marking with respect to a child, woman or man is also conceivable. It is furthermore conceivable for the markings to serve the purpose that a valve housing to be slid onto the snorkeling tube section can be slid thereon in a correct position.

It is possible for the markings to be formed on the weakening contours at least in sections.

The snorkeling tube end facing an air inlet opening may be formed on the inner and/or outer surfaces such that a valve system, in particular a valve system according to the invention described above may be attached to the snorkeling tube end.

A flange surface of a preferably circular ring or elliptical shape may be formed on the further end, i.e. the snorkeling tube end facing away from the air inlet opening. Such a flange surface may serve, for instance to lock the snorkeling tube in a system housing of a mouthpiece system. For example, such a snorkeling tube having a flange surface may be introduced into and locked in a system housing of a mouthpiece system according to the invention.

The explanations with respect to optional embodiments of a snorkeling tube end, in particular the explanations with respect to the design of the inner and/or outer surfaces, as well as the optional design of a flange surface of an in particular circular or elliptical shape likewise apply in the context of the further snorkeling tubes according to the invention described in the description.

A further independent aspect of the invention relates to a snorkeling tube for a breathing aid for swimmers, with a tube area section facing the head of a swimmer comprising a depression, and a magnetic element being inserted and attached in the depression.

Such a depression, for instance may be an indentation in the material of the tube or the tube area section. The depression may also be understood as a surface shape introduced in the manner of a stamp. Such a depression serves to receive a magnetic element. The magnetic element is inserted and attached in the depression. The magnetic element may be glued in the depression, for example.

Preferably, the magnetic element is introduced in the depression in a manner so as not to protrude beyond the remaining tube area sections that do not comprise a depression. Such a protruding material could cause head injuries to a swimmer. Preferably, the magnetic element is flush with the remaining tube area. It is furthermore conceivable for the magnetic element to have such a material thickness that the depression is deeper than the material thickness so that a difference in height is created with respect to the tube area sections that do not comprise a depression, and the surface of the magnetic element pointing toward the swimmer's head.

The magnetic element may be formed to be elongated, for example. It is furthermore conceivable for the shaping of the magnetic element to be adapted to the course of the snorkeling tube. It is in particular possible for the magnetic element to have a curvature corresponding to the snorkeling tube's curvature.

For example, the magnetic element may cooperate with a fastening magnet of swimming goggles or diving goggles or a head band or a head attachment system of the breathing aid. In this case, it is conceivable for swimming goggles or diving goggles or a head band or a head attachment system of the breathing aid to comprise a fastening magnet, for instance in the form of a magnetic button. This magnetic button may be fastened selectively along the magnetic element so that the snorkeling tube's position varies in relation to the element to which the snorkeling tube will be fastened, that is to say, the swimming goggles or diving goggles or the head band or the head attachment system of the breathing aid. With a magnetic element of an elongated design, the fastening magnet or magnetic button may be fastened at different positions of the magnetic element. The magnetic element may comprise a plurality of spaced apart markings, with the snorkeling tube's positioning being adjustable by means of the markings.

A further independent aspect of the invention relates to a breathing aid for swimmers, comprising at least two snorkeling tubes, a mouthpiece system, and a head attachment system. The two snorkeling tubes may be a snorkeling tube according to the invention as already described. The mouthpiece system as well may be a mouthpiece system according to the invention.

The head attachment system comprises two elongated fastening elements, each comprising a first and a second end portion, wherein in each case the first end portion of one fastening element is fastened or can be fastened to each snorkeling tube, with the position of the second end portions being mutually adjustable by a latching system. Such a latching system, for instance should be understood as a system comprising racks and gear wheels. Here, it is conceivable for the second end portions of the elongated fastening elements to comprise racks or rack portions which are mutually positioned by means of a gear wheel. Such a latching system may comprise a turning knob and/or a ratchet lever, for example.

The snorkeling tubes may be mounted to be rotatable in a system housing of the mouthpiece system.

At least one of the two snorkeling tubes may have a groove-shaped depression on a tube area section facing the head of a swimmer, with the first end portion of a fastening element being positionable in the depression in a rail-like manner. A depression of a tube area section means forming a groove without the tube area section's material exhibiting a cut-out. Such a depression may be introduced into the snorkeling tube in the manner of a stamp, for example. The depression preferably has such a depth that the first end portion of a fastening element is flush with the remaining tube area sections, i.e. the tube area sections that do not comprise a groove-shaped depression. The material thickness of the fastening element's first end portion therefore is preferably adapted to the grove-shaped depression's depth.

Rail-like positioning the fastening element's first end portion in the groove-shaped depression should be understood such that the first end portion is displaceable in the direction of the mouthpiece system or in the direction of the opposite tube end.

The first end portion of a fastening element may have a plurality of recesses, in particular a plurality of holes, with the first end portion being fastened or can be fastened in the depression by a fastening means that can be introduced into at least one of the recesses.

It is furthermore conceivable for a plurality of recesses, in particular holes to be formed as well in the groove-shaped depression so that a fastening means may be introduced both through a hole of an end portion of the fastening element and through a hole of the depression. In a further embodiment of the invention, it is conceivable for the depression to have a plurality of fastening elements, for instance in the form of push buttons or pins so that the first end portion of a fastening element can be placed on top of theses push buttons or pins in a clamping manner. The push buttons may also be referred to as rivet-like elements that are formed in the groove-like depression.

The head attachment system's latching system may comprise a turning knob and/or a ratchet lever. The second end portions of the two elongated fastening elements may be mutually positioned by means of the turning knob. Such turning knobs are already known from other fastening systems, so that the head attachment system is easy to handle. Ratchet levers are known from snowboard bindings, for example. Such a design is also associated with easy handling of the head attachment system.

On the side of the head attachment system facing the head of a swimmer, a head contact plate may be formed in the area of the latching system. Such a head contact plate improves the wearing comfort. It moreover prevents hair from getting into the latching system, for example. The fastening forces are distributed by means of a head contact plate so that the fastening forces will not affect just a single point. The head contact plate may be of an arched design and made of a soft plastic material, for example, so that the wearing comfort is improved.

In the breathing aid's state of use, i.e. in a state where the head attachment system is effective on the swimmer's head, the turning knob and/or the ratchet lever, relative to a dental support plate of a mouthpiece, is located on a line arranged at an angle of 30° to 60°, in particular of 40° to 50°, in particular of 45° to the dental support plate. In a side view, this line is visible on the swimmer's head. The dental support plate serves as a first reference line, whereas the imaginary line from the dental support plate to the center of the turning knob or the center of the ratchet lever represents the second reference line. The ratchet lever's center, for instance, may pass through, preferably perpendicular to, the ratchet lever's axis of rotation.

An optimum angle is set, at which unpleasant traction forces for the swimmer on the palate and/or gingiva will not be created despite the breathing aid's attachment to the head. As compared to systems known from prior art, the ergonomics of the breathing aid according to the invention is vastly improved.

It is moreover possible for the snorkeling tubes to have a D-shaped cross-section. A cross-section of such a design is minimized in particular with respect to water resistance. Preferably, the snorkeling tubes are arranged to pass in parallel over the swimmer's cheeks.

A further independent aspect of the invention relates to a method for putting on a breathing aid for swimmers, in particular a breathing aid according to the invention described above. The method according to the invention comprises the steps of:

- inserting a mouthpiece into the swimmer's mouth,
- pivoting at least one snorkeling tube,
- attaching the breathing aid on the swimmer's head by means of a head attachment system.

At least one snorkeling tube is pivoted according to the invention such that a turning knob and/or a ratchet lever of the head attachment system is located relative to a dental support plate of the mouthpiece on a line arranged at an angle of 30° to 60°, in particular of 40° to 50°, in particular of 45° to the dental support plate. In this context, the same explanations and advantages apply as already mentioned above with respect to the breathing aid according to the invention.

The attaching of the head attachment system may be performed by turning a/the turning knob or by actuating a/the ratchet lever.

Since the mouthpiece is merely inserted into the swimmer's mouth in a first step, the positioning of the snorkeling tube or snorkeling tubes may be performed in the subsequent step in a comfortable way. The positioning is possible since the snorkeling tube ends are mounted to be rotatable in the mouthpiece's system housing. Only after an ideal positioning of the snorkeling tubes has taken place, the breathing aid will be attached to the swimmer's head or back of the head. The mouthpiece's positioning in the swimmer's mouth is not changed during the pivoting of the snorkeling tubes or during the attaching of the breathing aid.

A further aspect of the invention is aimed at an element or at a component of a swimming aid that enables an improved use of the swimming aid even when performing flip turns. So far, water enters the air inlet openings of known swimming aids when flip turns are performed. The element or component for water repellency according to the invention or the water-repelling element or water-repelling component according to the invention has the effect that water will not enter an air inlet opening of a breathing aid when a flip turn is performed. This may concern both an air inlet opening of a snorkeling tube and an air inlet opening of a valve system. The element or component for water repellency may be formed as a diffusor plate or a diffusor extension. For the diffusor plate and/or the diffusor extension, the same explanations and/or correlations may apply as already described above in the context of the mouthpiece system according to the invention. The element or component, for instance, has such a structure and/or geometry and/or shape that water is deviated sideways in performing a flip turn and cannot enter the breathing aid through an air inlet opening, after all.

The element or component, for instance, may be of a design to be integrated in a separate cap system or be formed as a separate cap system. The cap system may be fastened to or mounted on a snorkeling tube. It is moreover conceivable for the cap system to be fastened to or mounted on a valve housing of a valve system. In a further embodiment, it is conceivable for the cap system to be of a design of being integrated in a valve housing of a valve system. It is in particular conceivable for the cap system to be of a design of being integrated in a valve housing of a valve system according to the invention. Here, it is conceivable for the valve housing to have a diffusor plate.

A further independent aspect of the invention relates to swimming goggles and/or diving goggles having a head attachment system, having two elongated fastening elements, each comprising a first end portion and a second end portion, with the first end portions pointing toward the lens or lenses of the swimming goggles and/or diving goggles, with the position of the second end portions being mutually adjustable by a latching system.

The latching system may comprise a turning knob and/or a ratchet lever.

The first end portions of the fastening element may each be connected to an edge portion of the lenses or lens. If diving goggles are formed with a head attachment system, it may be provided that only one lens is formed so that the first end portions of the fastening elements each are mounted on a separate edge portion of a common lens or connected to this edge portion.

In a further embodiment of the invention, it is possible for the first end portions of the fastening elements and the edge portions of the lenses or the lens to be formed in one piece. In other words, the edge portions and the fastening elements are formed in one piece. It is therefore not necessary to connect the end portions of the fastening elements or the fastening elements to the edge portions. The edge portions of swimming and/or diving goggles may also be referred to as lateral frame portions.

Swimming and/or diving goggles of such a design thus are of a rubber-free design. In other words, the use of standard attachment bands of rubber is dispensed of. Rather, the fastening elements are formed from a material, in particular a plastic material, for example. In comparison to the material of rubber bands, this is formed to be reinforced. Breaking or wear and tear of rubber bands is avoided by means of such swimming and/or diving goggles. Due to the use of a latching system for attaching the swimming and/or diving goggles to the swimmer's head, a variable adjustment of the swimming goggles may be performed. Tightening of rubber bands is not necessary.

On the side of the head attachment system facing the head of a swimmer, in particular in the area of a/the turning knob or a/the ratchet lever, a head contact plate may be formed. The head contact plate, for instance, may be adapted to the swimmer's head shape, in particular be realized to be arched. The head contact plate prevents hair from entangling in the head attachment system. Moreover, the latching system does not only act upon a point of attachment but upon a head contact plate so that the fastening forces are distributed. The wearing comfort is increase in this respect.

Furthermore, it may be provided for at least one elongate fastening element, which may also be referred to as a plastic lobe, to comprises at least one recess which is preferably formed in the shape of a slotted hole. Due to such a recess, weight is saved with respect to the fastening elements, on the one hand. On the other, flexibility of the fastening elements is effectuated by forming recesses of a slotted hole shape. For example, it is conceivable that the swimming and/or diving goggles according to the invention can be stored simply in a storage container by bending the head attachment system, in particular the area of the head contact plate, in the direction of the lenses or in the direction of the lens. Due to the recess(es), the fastening elements cannot break in the bent areas.

A further independent aspect of the invention relates to a snorkeling tube for a breathing aid for swimmers, comprising a first portion facing a mouthpiece, and a second portion having an air inlet opening, with the snorkeling tube being bent several times. In other word, the snorkeling tube according to the invention is bent at least twice, with the bending being able to produce a spherical shape of the snorkeling tube. In other words, the bending axes do not have to match.

The snorkeling tube has at least one first portion and a second portion, with the snorkeling tube's first portion facing a mouthpiece of a breathing aid, and the snorkeling tube's second portion comprising an air inlet opening.

An air flow when inhaling through the snorkeling tube thus occurs from the second portion to the first portion. It is also conceivable for a further portion of the snorkeling tube to be formed between the first portion and the second portion. When viewing the snorkeling tube in the breathing aid's state of use in a side view, the snorkeling tube may be formed such that the second portion is angled from the first portion in particular by 5° to 30°, in particular by 10° to 20°, in particular by 12° to 18°, in particular by 15°. The indicated state of use of the breathing aid in a side view thus relates to the view of a snorkeling tube with the breathing aid applied, with the side view being such that the swimmer's profile is visible. In this view, the second portion is formed to be angled from the first portion.

Furthermore, the second portion may be angled from the first portion in the direction of the mouthpiece's blow-out direction.

The snorkeling tube's first portion may have a linear longitudinal extension corresponding to at least 1.2 times, in particular at least 1.5 times, in particular at least 1.8 times, in particular at least 2 times, in particular at least 3 times the linear longitudinal extension of the second portion. As the linear longitudinal extension in this case, the linear distance of the first portion's first end from the first portion's second end is understood. The first portion's first end is in particular that end of the snorkeling tube which will be connected to the mouthpiece. The linear longitudinal extension results, for example, from viewing the snorkeling tube in the breathing aid's state of use in a side view. The linear longitudinal extension thus does not explicitly follow the snorkeling tube's bending. The same applies to the linear longitudinal extension of the second portion. In this context as well, it holds true that the linear longitudinal extension corresponds to the distance of the second portion's first end from the second portion's second end. The second portion's second end, for example, may be that end of the snorkeling tube which will be connected to a valve system.

In other words, the first portion is at least 1.2 times, in particular at least 1.5 times, in particular at least 1.8 times, in particular at least 2 times, in particular at least 3 times longer than the second portion of the snorkeling tube.

The snorkeling tube according to the invention may have an oval and/or D-shaped and/or elliptical cross-section that is formed at least in sections. It is conceivable for the snorkeling tube to have different or differently shaped cross-sections over its entire length. In particular, the snorkeling tube's first portion may have a substantially D-shaped cross-section. This D-shaped cross-section may merge into an oval cross-section toward the snorkeling tube's second portion.

When viewing the snorkeling tube in the breathing aid's state of use in a top view, the first portion and/or the second portion may have a bending corresponding to the head shape of a swimmer. The breathing aid's state of use in a top view describes the view of the upper head or top of the skull of a swimmer with the breathing aid applied. In this view, it is possible for the first portion and/or the second portion to have a bending corresponding to the swimmer's head shape. The snorkeling tube may have at least one convex portion, preferably a plurality of convex portions, i.e. portions having an outward curvature. Outward curvature means here a curvature corresponding to the round cheek shape in a top view. It is possible for the first portion and/or the second portion to have a plurality of convex bends having different bending radii.

The snorkeling tube may be formed from at least two snorkeling tube shells with the snorkeling tube shells being interconnected, in particular glued and/or welded and/or clamped and/or latched. The snorkeling tube's separating plane which is formed by the connection of two snorkeling tube shells, extends preferably in a straight line along the snorkeling tube's longitudinal extension, when viewing the snorkeling tube in the breathing aid's state of use in a side view. It is also possible for the separating plane to extend obliquely from the snorkeling tube's first end to the snorkeling tube's second end.

On the outer surface of the snorkeling tube's second portion, a step may be formed such that a cap-like housing, in particular a valve housing is slid or may be slid onto the second portion at least in sections. A step in the snorkeling tube's second portion may in particular be formed by reducing the wall thickness in the second portion at least in sections, with the inner diameter substantially remaining the same. A step edge is thus formed which is formed by reduction of material of the second portion. The step edge may serve as a stop edge for the cap-like housing, in particular valve housing, that is slid onto the snorkeling tube's second portion.

In other words, the snorkeling tube housing may have a reduced outer circumference in a cross-section in the area of the step as compared to the remaining snorkeling tube housing of the second portion.

Furthermore, it is possible for at least one connecting means, in particular a latching means, to be formed on the snorkeling tube's second portion, in particular in the area of a/the step, said connecting means serving for connecting a cap-like housing, in particular a valve housing, to the snorkeling tube. As the connecting or latching means, a knob-like or button-like element may be formed which snaps into a recess of the cap-like housing or valve housing. It is also conceivable for the connecting means to be of a different design. In particular, so-called tongue-and-groove connection types are possible here, wherein the groove and/or the tongue can be optionally formed on the snorkeling tube's second portion and/or on the cap-like housing.

The snorkeling tube according to the invention is characterized by an extremely aerodynamic shape so that the resistance during swimming is minimized as compared to conventional snorkeling tubes.

A further independent aspect of the invention relates to a breathing aid for swimmers, comprising at least one snorkeling tube, in particular a snorkeling tube according to the invention described above, and a valve system, in particular a valve system according to the invention described above. The valve system comprises a/the valve housing which is connected to the snorkeling tube, in particular in a clamping manner, with an end cap being connected to the valve housing, in particular in a clamping manner.

The end cap may have an end surface that is extending obliquely. This end surface preferably is the surface that is at a maximum distance from the valve housing. The end surface may extend obliquely in such a manner that the end cap in a side view, in particular a side view in the breathing aid's state of use, i.e. in a position applied to a swimmer, extends in a pointed or arrow-shaped manner. This is a particularly aerodynamic shape of the end cap. Due to the end cap's shape, in particularly due to the end surface preferably extending obliquely, water is prevented from entering the end cap and consequently the valve system.

A plurality of cross members of a lamella-like arrangement may be formed in the end surface. The cross members of the lamella-like arrangement prevent water from entering the end cap. With an end cap formed in such a manner, a flip turn can in particular be performed with the breathing aid.

The cross members of the lamella-like arrangement are arranged at an angle to the end surface, with the angle being 20° to 70°, in particular 30° to 60°, in particular 40° to 50°, in particular 42° to 48°.

In a further embodiment of the breathing aid according to the invention, the end cap can have just one opening which is formed to connect to the valve housing. In a state of being connected to the valve housing, external air may not flow in through this end cap. The end cap consequently inhibits the air supply to the valve housing. Such an end cap may be provided if the breathing aid comprises two snorkeling tubes, and on the valve housing no end cap or just one end cap with, for instance, cross members of a lamella-like arrangement is arranged, and consequently an end cap without an air supply may be formed on the further snorkeling tube.

An end cap having just one opening, namely a connecting opening for the valve housing, may facilitate the use of a breathing aid having two snorkeling tubes, if, for instance during a flip turn to be performed, the swimmer's head is turned in a preferred direction. When a crawling movement is made, swimmers will also move their heads sideways so that the end cap should be formed with just one opening on the snorkeling tube's side or connected to the snorkeling tube's valve housing, to which side the swimmer will turn the head.

The breathing aid according to the invention may comprise a mouthpiece system according to the invention described before.

It should be noted at this point that the aspects according to the invention, in particular the valve system according to the invention and/or the mouthpiece system according to the invention and/or the snorkeling tubes according to the invention and/or the element or component for water repellency according to the invention and/or the breathing aid according to the invention may be optionally combined with one another.

The invention will be explained hereinafter in greater detail based on exemplary embodiments with reference to the appended drawings. Further features and advantages of the invention will be apparent from the following description in conjunction with these drawings.

Figure 1B:
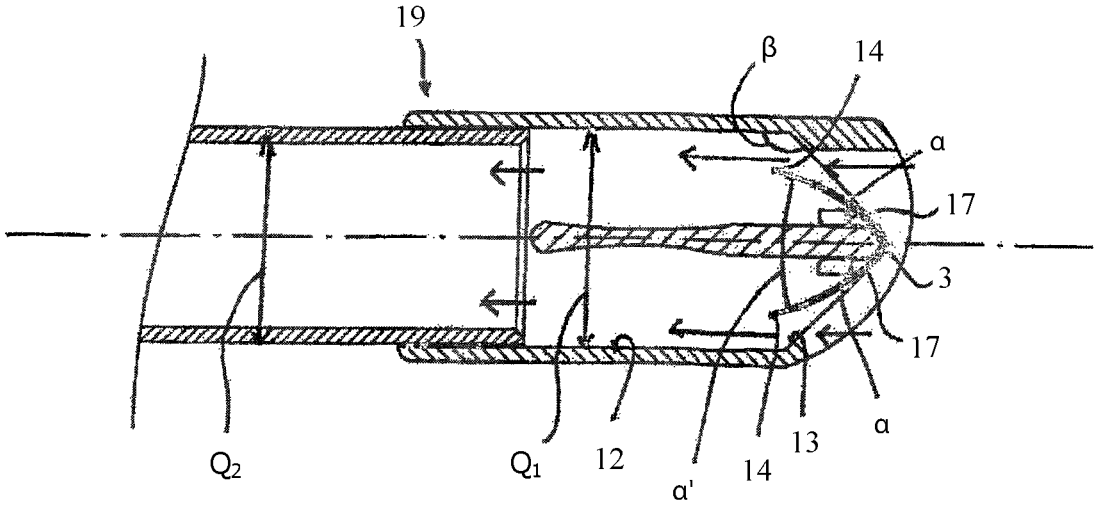
Figure 1C:
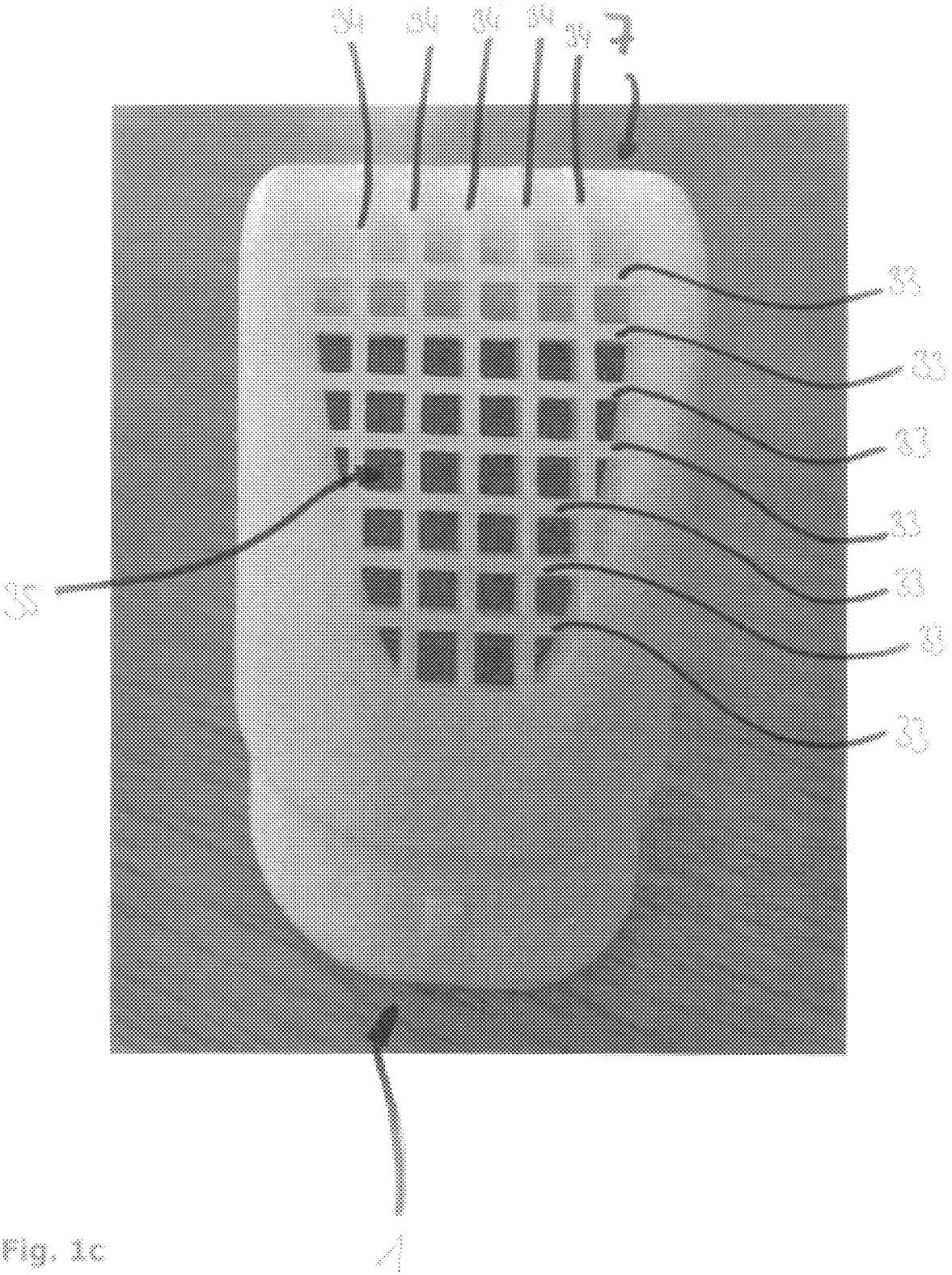
Figure 1D:
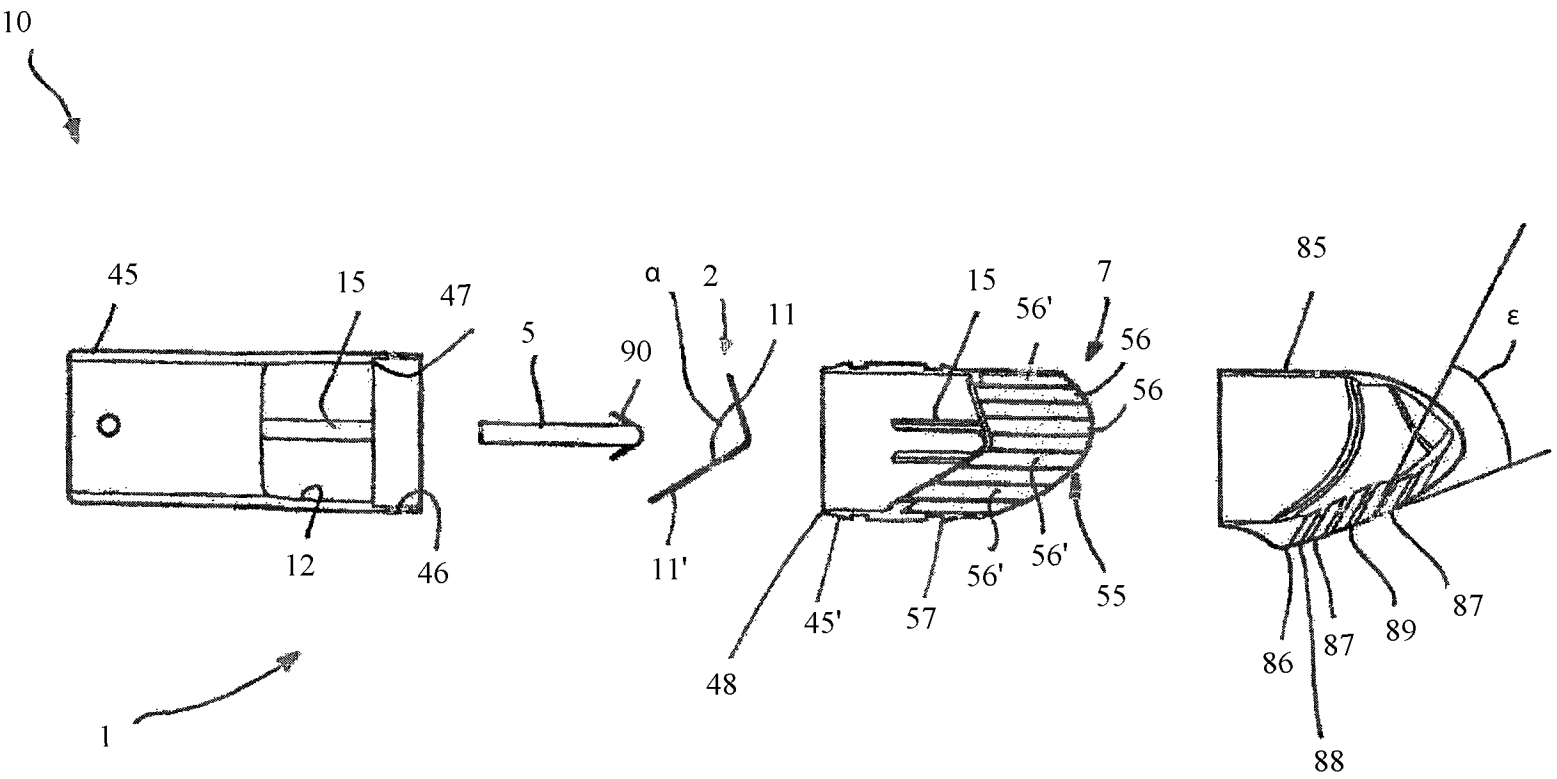
Figure 1E:
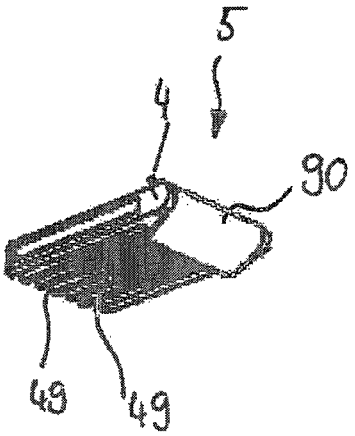
Figure 1F:
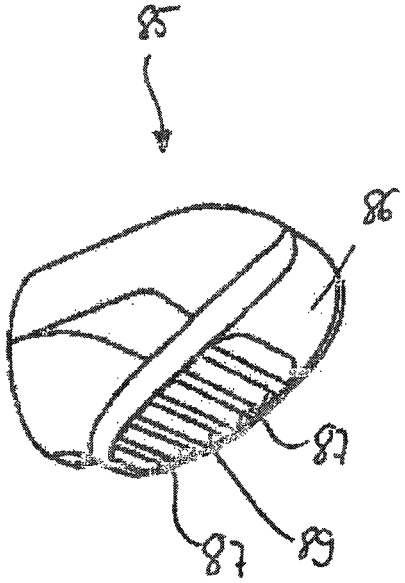
Figure 1G:
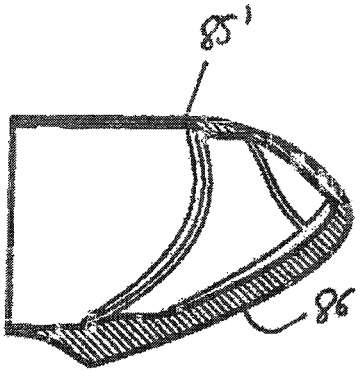
Figure 3A:
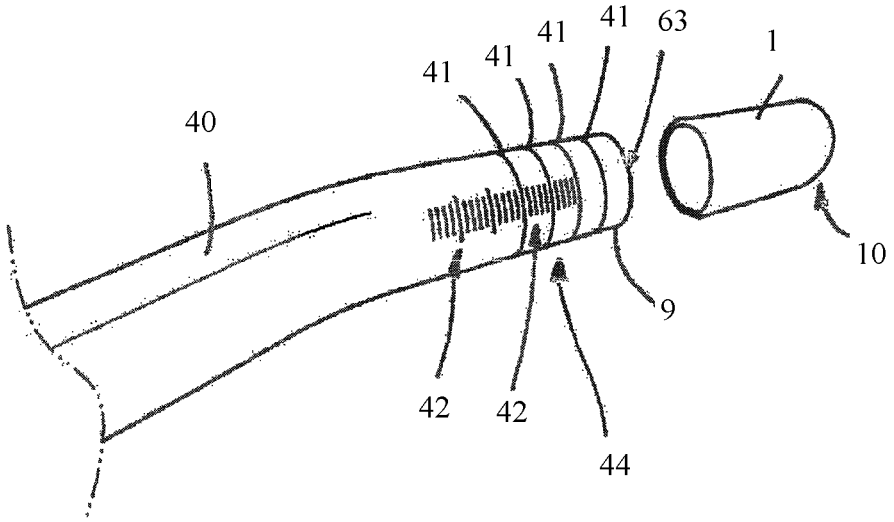
Figure 3B:
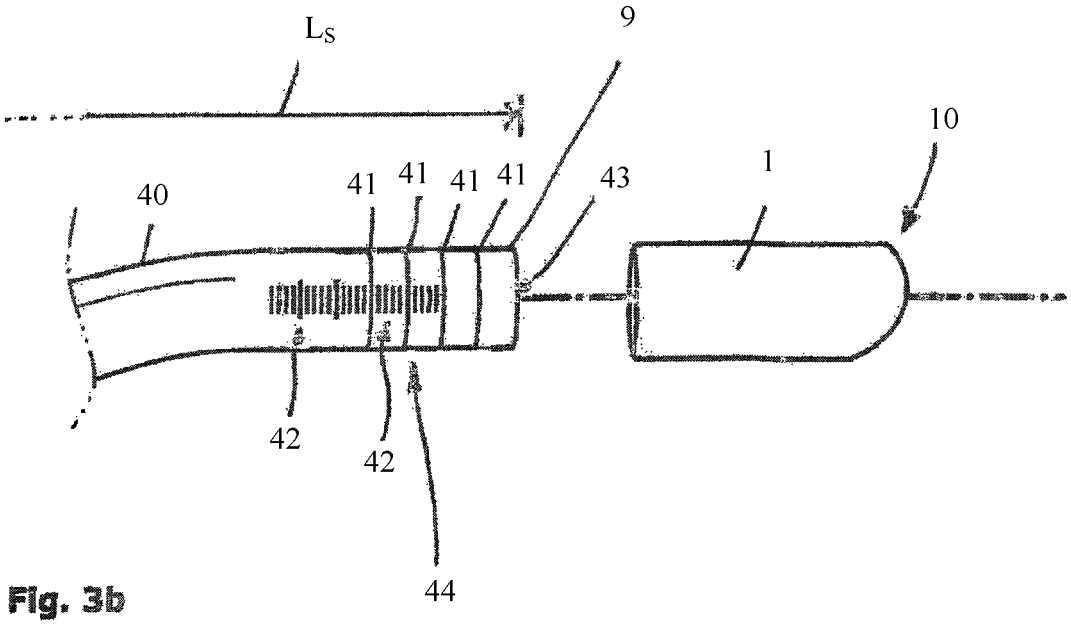
Figure 5:
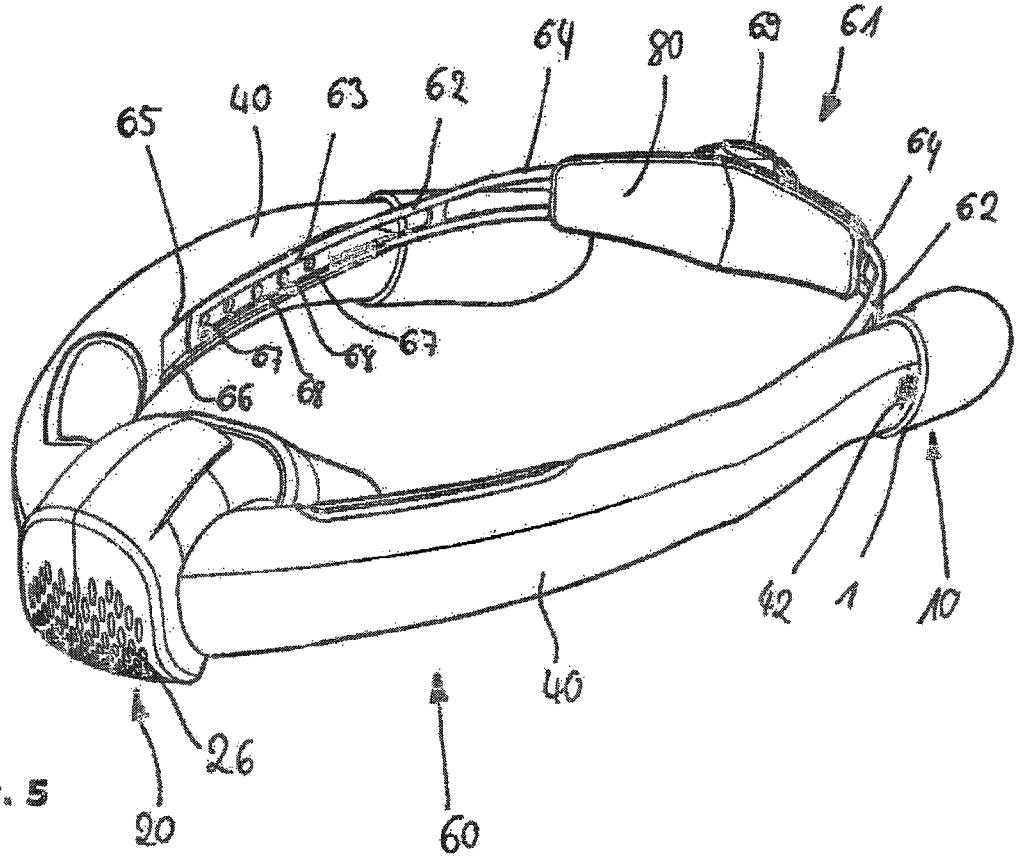
Figure 6A:
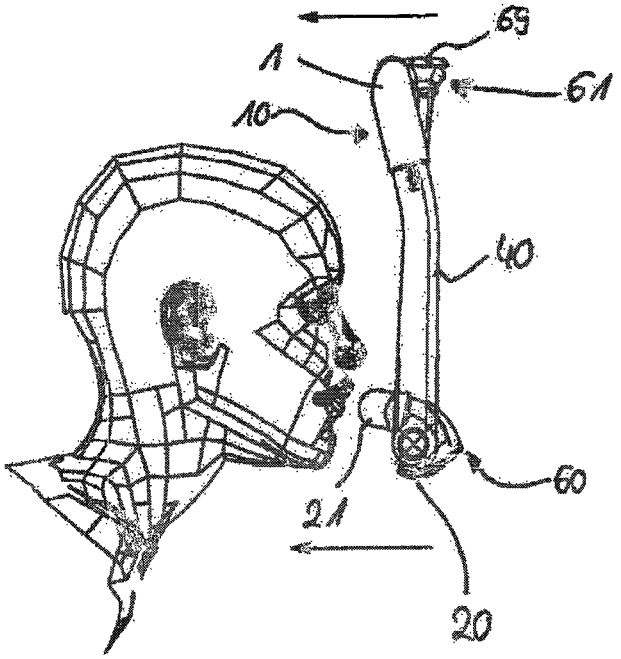
Figure 6B:
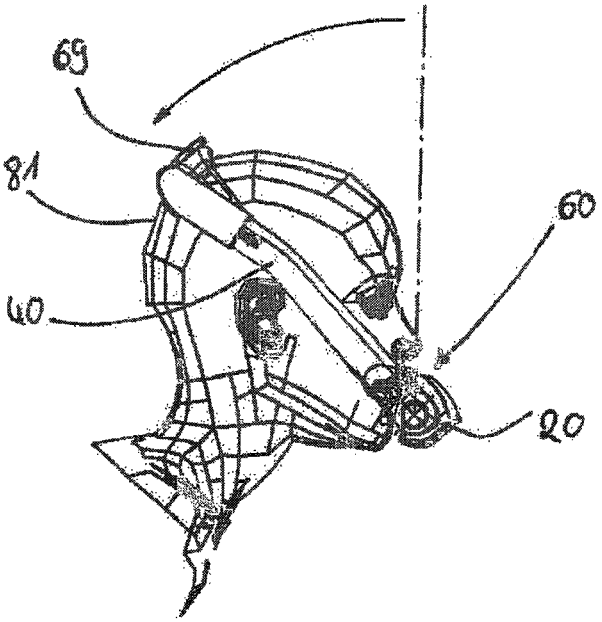
Figure 6C:
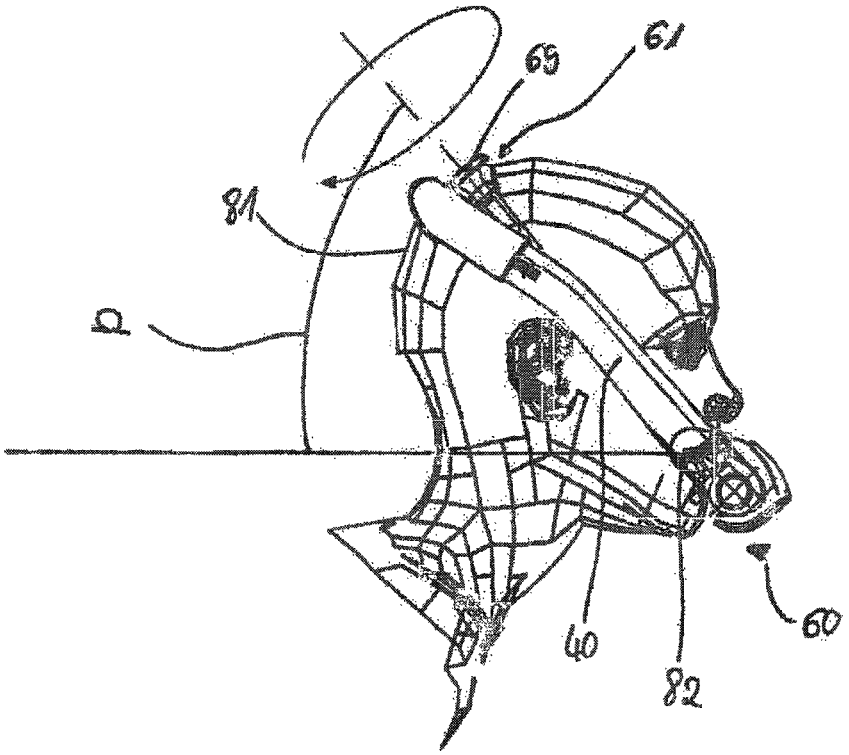
Figure 7A:
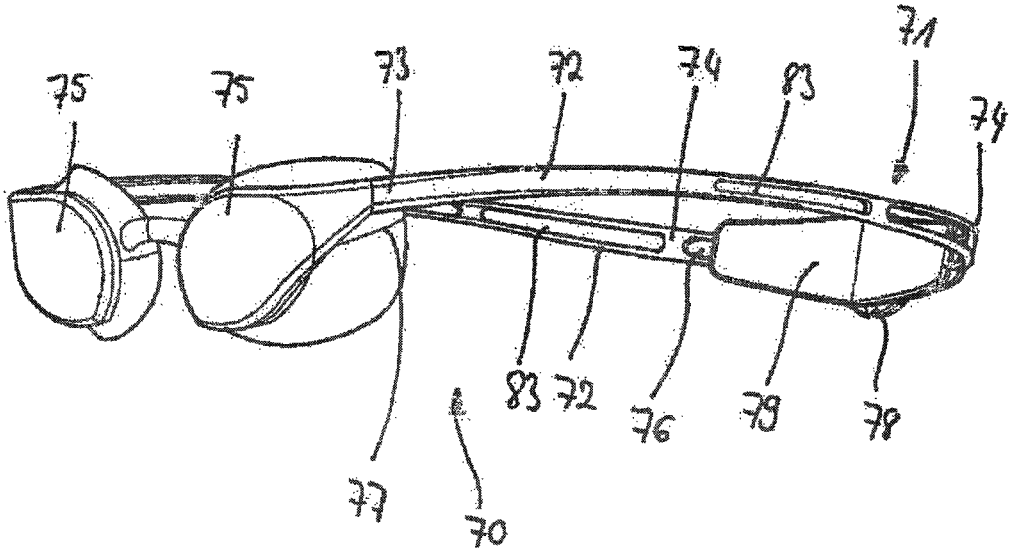
Figure 7B:
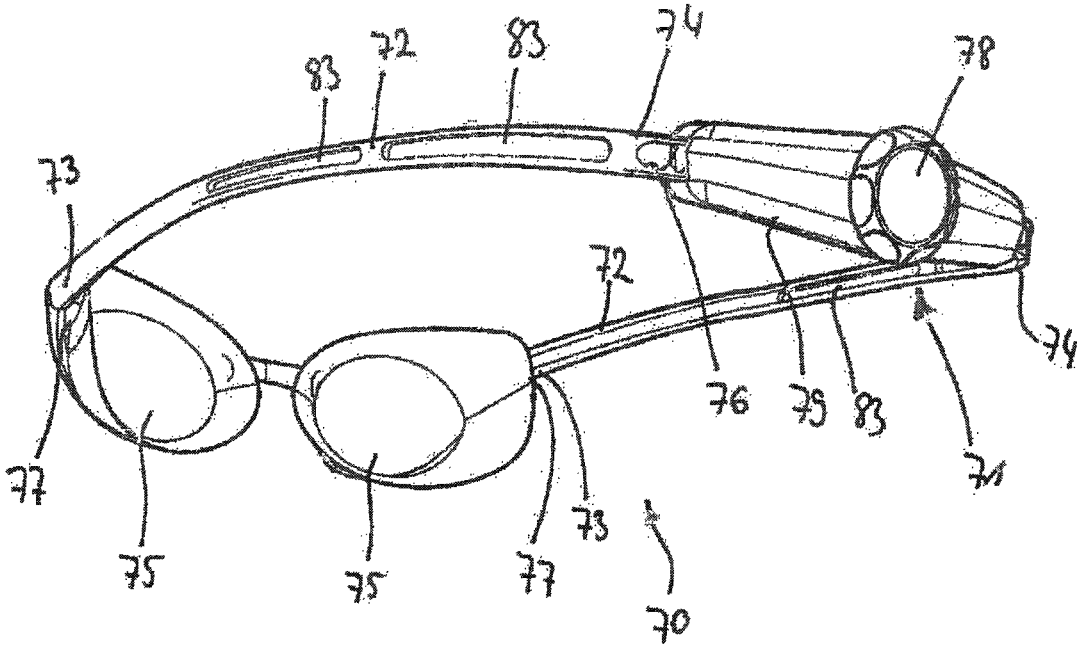
Figure 7C:
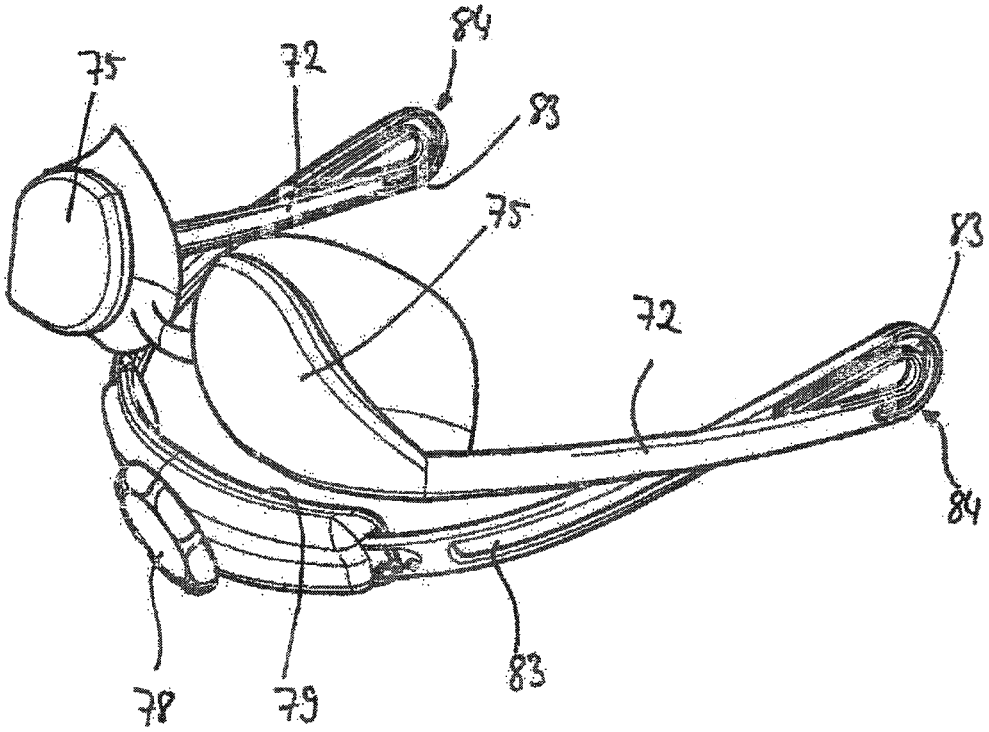

Shown is/are in:

FIGS. 1*a*, 1*b*: a valve system according to the invention;

FIG. 1*c*: an optional embodiment of a valve housing of a valve system;

FIG. 1*d*: a further embodiment of a valve systems in an exploded view in a cut;

FIG. 1*e*: a perspective view relating to a fastening element of the valve system;

FIG. 1*f*: a perspective view of an end cap;

FIG. 1*g* a perspective view of a further embodiment relating to an end cap;

FIGS. 2*a*-2*h*: a mouthpiece system according to the invention, and components of this mouthpiece system;

FIGS. 3*a*, 3*b*: a snorkeling tube according to the invention with weakening contours;

FIGS. 4*a*-4*e*: a snorkeling tube according to the invention with a magnetic element;

FIG. 5 a breathing aid according to the invention;

FIGS. 6*a*-6*c*: single steps of the method according to the invention for putting on or attaching a breathing aid for swimmers; and FIGS. 7*a*-7*c*: swimming goggles according to the invention.

Hereinafter, identical reference numerals will be used for identical parts or parts of identical action.

In FIGS. 1*a* and 1*b*, a valve system 10 according to the invention for a breathing aid for swimmers is illustrated. The illustrated valve system 10 is an inhalation valve system. It comprises a valve housing 1 and a valve diaphragm 2 arranged in the valve housing 1, with the valve diaphragm 2 being arranged on a contacting section 3 at a first end 4 of a fastening element 5. The valve system's 10 representation is in a longitudinal cut view. The illustrated right-hand opening is the air inlet opening 7 through which ambient air enters the valve housing 1 during inhalation. The second opening 8 of the valve housing serves to connect to a snorkeling tube end 9.

In the illustrated example, the contacting section 3 rests upon the fastening element's 5 first end 4. The fastening element 5 is of a stem-like design. From the contacting section 3, the valve diaphragm is formed to be angled toward the fastening element's 5 second end 6.

In the illustrated longitudinal cut view, the valve diaphragm 2 can be divided in two valve diaphragm sections 11 and 11'. The valve diaphragm sections 11 and 11' are angled from the contacting zone 3 toward the fastening element's 5 second end, with the two valve diaphragm sections 11 and 11' enclosing an angle $\alpha$ of 80° to 95°. The valve diaphragm sections 11 and 11' accordingly are formed to be angled such that they are oriented toward the second opening 8 which is formed to be opposite to the air inlet opening 7.

The valve system's 10 state of exhalation or rest is shown in FIG. 1*a*. The valve housing 1 is formed to be sleeve-like, with a boundary surface 13 being formed on the valve housing's 1 inner surface 12 so as to protrude inward, namely in the direction of longitudinal axis L. The boundary surface 13 is formed over the entire circumference and protrudes obliquely from the valve housing's 1 inner surface 12. Consequently, the angle between the boundary surface 13 and the inner surface 12 is larger than 90°.

The valve diaphragm's 2 end portion 14 which is formed to be at a maximum distance from contacting section 3 rests upon boundary surface 13 in the illustrated state of exhalation or rest in FIG. 1. Preferably, the angle $\beta$ between inner surface 12 and boundary surface 13 is formed such that the distance of the valve diaphragm's 2 end portions 14 may be maintained at the predetermined angle $\alpha$ which is enclosed by the two valve diaphragm sections 11 and 11'. Angle $\beta$ thus is 180° minus angle $\alpha$.

Fastening element 5 is formed at the first end 4 in a clamping portion 15. Valve diaphragm 2 rests upon the clamping portion 15. The clamping portion has beveled surfaces 16, with the beveled surfaces 16 defining the valve diaphragm's 2 angle toward the fastening element's 5 second end. Portions 17 of valve diaphragm 2 rest upon the clamping portion's 15 beveled surfaces 16. Angle $\gamma$ of the beveled surfaces 16 corresponds to half of the angle $\alpha$ in the illustrated example.

The portions 17 of valve diaphragm 2 may also be connected to the clamping portion's beveled surfaces 16. The portions 17 of valve diaphragm 2 are formed to be in proximity to contacting section 3 or adjacent to contacting section 3 of valve diaphragm 2. The angle of the valve diaphragm consequently cannot be changed in contacting section 3 and in valve diaphragm's 2 portion 17.

The tappet-like fastening element 5 and/or the clamping portion 15 may be formed as a flow divider in the valve housing 1.

The state of inhalation is shown in FIG. 1*b*. In this state, air flows into the valve system's 10 valve housing 1 along the illustrated arrows. In the inhalation process, the angle $\alpha'$ enclosed by the valve diaphragm sections 11 and 11' will decrease. This is because the valve diaphragm's 2 end portions 14 will be angled even more in the direction of the fastening element's 5 second end 6 or even more in the direction of the valve housing's 1 longitudinal axis L. The angle enclosed by the valve diaphragm's portions 17 from contacting section 3 cannot be decreased because these portions 17 are resting upon the clamping portion's 15 beveled surfaces 16. Since the angle of valve diaphragm sections 11 and 11' is decreased, and the valve diaphragm's end portions 14 are moved in the direction of the valve housing's longitudinal axis L or in the direction of fastening element's 5 second end 6, a gap is created between the valve diaphragm's 2 end portions 14 and the boundary surface 13 through which air can enter.

At the time when no more air is inhaled, the valve diaphragm's end portions 14 are moved back to the boundary surfaces 13 so that no more air can flow in and air is also prevented from flowing out. Valve housing 1 may have strut-like elements 18 at the air inlet opening 7 (see FIG. 2*a* in this respect). Due to these strut-like elements 18, dirt particles etc. are prevented from entering the inside of valve housing 1. In the illustrated example, valve housing 1 is slid onto the snorkeling tube portion 9 in a clamping manner. To this end, the valve housing's 1 inner cross-section $Q_1$ has a slightly larger value than the snorkeling tube end's 9 outer cross-section $Q_2$.

At the valve housing's 1 end portion 19 facing away from the air inlet opening 7, at least one latching element and/or a latching surface may be formed on the inner surface and/or on the outer surface for fastening the valve system 10 to a snorkeling tube 40 or a snorkeling tube end 9.

A further embodiment of a valve housing 1 is illustrated in FIG. 1*c*. At the air inlet opening 7, the valve housing 1 has a plurality of horizontal strut-like elements 33 and a plurality of vertical strut-like elements 34. The horizontal strut-like elements 33 and the vertical strut-like elements 34 are formed to be mutually crossing. The strut-like elements 33 and 34 thus form a grid-like cover 35. The grid-like cover 35 may be formed to be spherical, i.e. the cover 35 may be curved. The strut-like elements 33 and 34 may also be referred to as web-like elements 33 and 34. Due to the grid-like cover 35, dirt particles etc. are prevented from entering the inside of valve housing 1.

FIG. 1*d* shows a further embodiment of a valve housing 1 having two valve housing sections 45, 45'. The valve diaphragm 2 and the fastening element 5 are likewise illustrated. The fastening element 5 is illustrated in more detail in FIG. 1*e*.

It is apparent from the exploded view that the valve housing sections 45, 45' are slid onto one another for forming valve housing 1. A clamping portion 15 is formed in the first housing section 45. The clamping portion 15 is a recess formed on the inner surface 12 of valve housing section 45. Such a recess is also formed on the opposite inner surface of valve housing section 45 so that the fastening element 5 that is formed to be plate-like may be slid into the recesses so that the clamping portion 15 causes a clamping connection of the fastening element 5 to the valve housing section 45.

On the valve housing section's 45 inner surface 12, a circumferential section 46 comprising a smaller material thickness is moreover formed. A stop edge 47 is formed due to the material reduction in section 46. The valve housing section 45', in particular the end edge 48 of valve housing section 45' gets in contact with the stop edge 47. The stop edge 47 has the effect that the valve housing section 45' cannot be slid further into the valve housing section 45. A clamping portion 15 is moreover also formed in the valve housing section 45' so that the fastening element 5 may be brought into a clamping connection to the valve housing section 45' as well.

The illustrated valve diaphragm 2 has two valve diaphragm sections 11 and 11', with the valve diaphragm 2 being formed to be not symmetrical in the illustrated example. Rather, valve diaphragm section 11' is longer than valve diaphragm section 11.

The valve housing section 45' has an air-permeable cover 55 on the air inlet opening 7. The air-permeable cover 55 reaches from the right-hand end of clamping portion 15 to the right-hand end of valve housing section 45'. Circular openings 56 are formed in the air-permeable cover 55. Due to the air-permeable cover's 55 material thickness, ducts 56' are formed. The air-permeable cover may also be referred to as a diffusor plate. Substantially the same explanations apply as will be given later in the context of a diffusor plate of a mouthpiece system.

A circumferential indentation 57 is moreover formed on the outer surface of valve housing section 45'. The end cap's 85 housing may engage into this indentation 57 so that the end cap 85 may be connected to the valve housing section 45' in a clamping manner or the end cap 85 may be slid onto the valve housing section 45'.

The end cap 85 has an end surface 86 that extends obliquely. Due to this end surface 86 that extends obliquely, the end cap 85 defines a pointed or arrow-shaped geometry. A plurality of cross members 87 of a lamella-like arrangement are formed in the end surface 86. Due to the cross members 87 of the lamella-like arrangement, opening 89 are formed. In relation to the end cap's 85 end edge 88, the openings 89 enclose an angle ε of 40 to 50°, in particular 45°. The illustrated end cap 85 should in particular be slid onto valve housing 1 when flip turns are intended to be performed with the valve system 10, in particular with a breathing aid comprising the valve system 10. Due to the cross members 87 of the lamella-like arrangement, water cannot enter the end cap 85 in performing a flip turn.

FIG. 1*e* shows the alternative embodiment of a fastening element 5. This is of a plate-like design. In this plate shape, recesses 49 extending in a longitudinal direction are also formed. The elongated recesses 49 preferably are formed on both sides of the plate shape. At the first end 4 of fastening element 5, an angled or angular guiding element 90 is formed. The angle α between the valve diaphragm sections 11 and 11' may be set by means of this guiding element.

The end cap 85 of FIG. 1*d* is illustrated in FIG. 1*f* in a perspective view. The end surface 86 that extends obliquely as well as the cross members 87 of the lamella-like arrangement may be seen.

A further embodiment of an end cap 85' is illustrated in FIG. 1*g*. This end cap 85', too, has an end surface 86 that extend obliquely. The only opening of end cap 85' is the opening for connecting to a valve housing 1 or a valve housing section 45'. The end cap 85' thus has the effect that air cannot enter the valve system. Consequently, such an end cap 85' should always be used in conjunction with a breathing aid having two snorkeling tubes so that a completely closed end cap 85' may be slid onto just one valve system of one snorkeling tube.

Figure 2A:
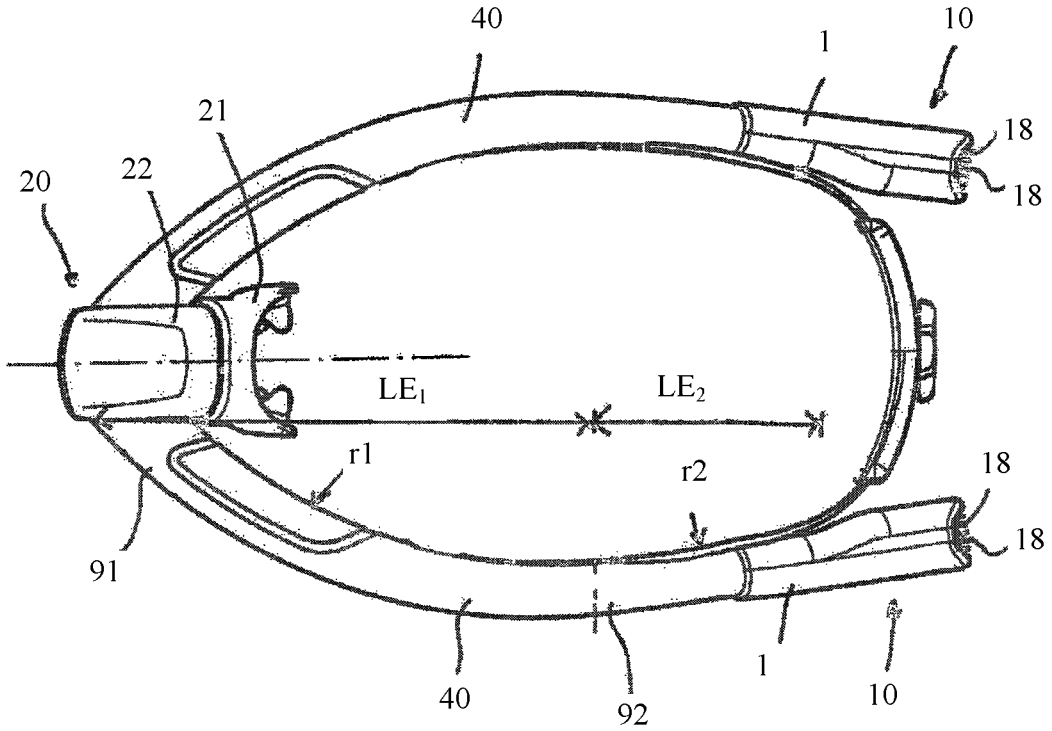
Figure 2B:
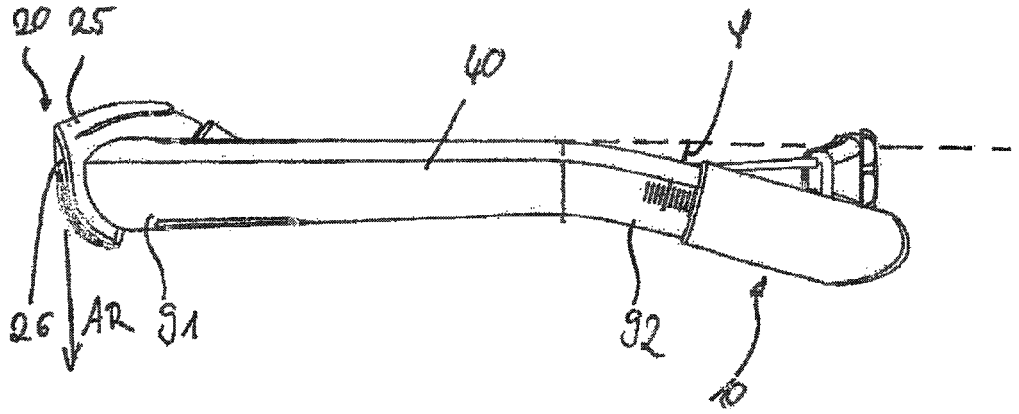
Figure 2C:
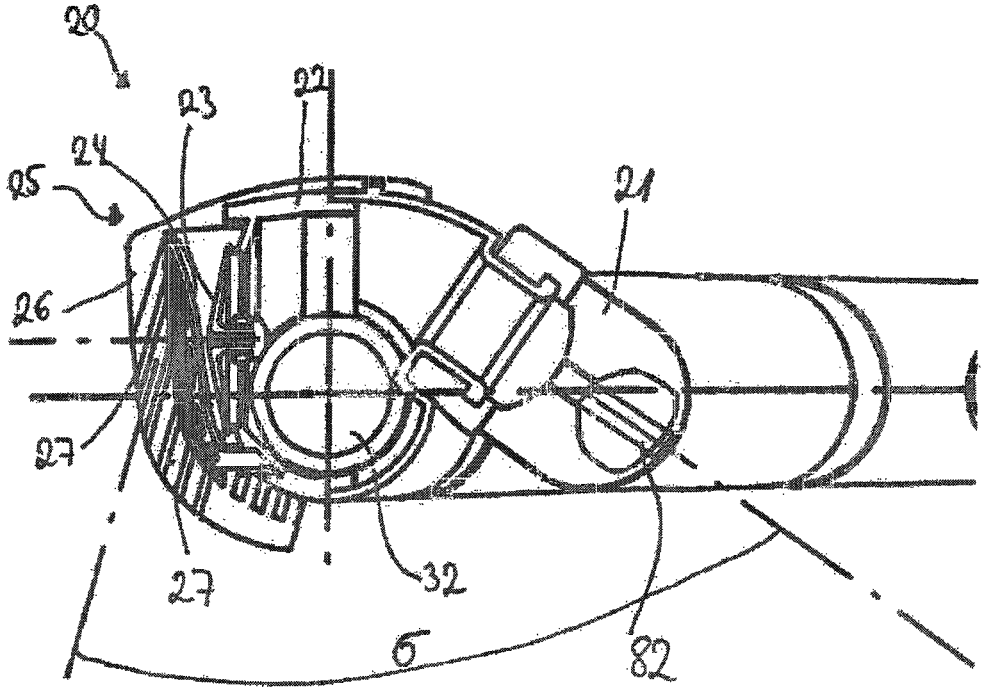
Figure 2D:
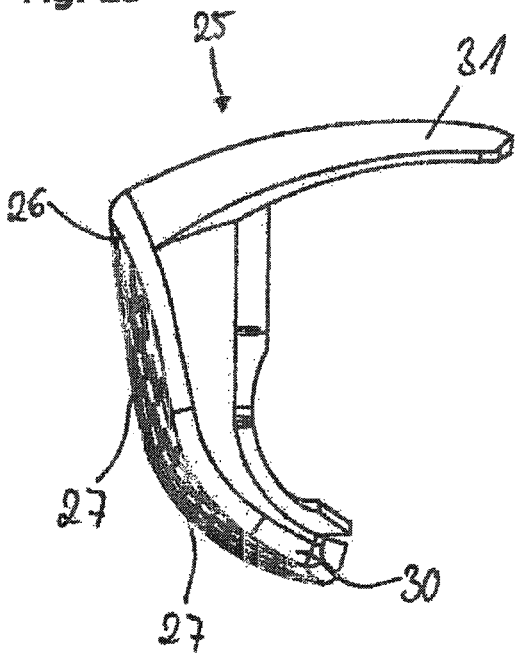
Figure 2E:
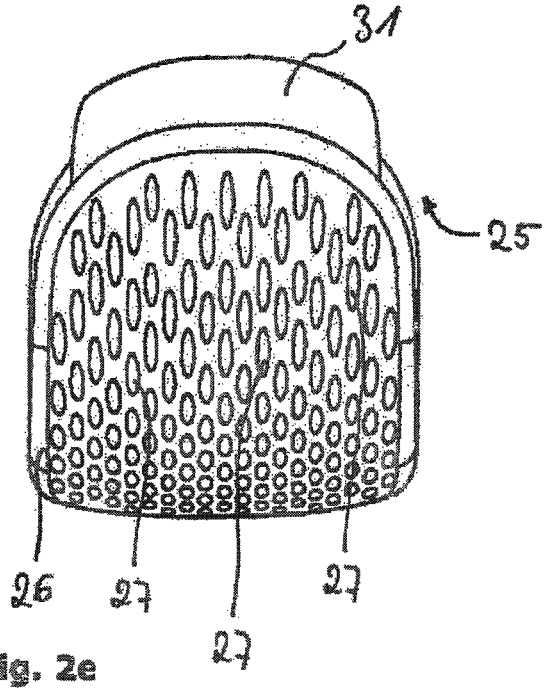
Figure 2F:
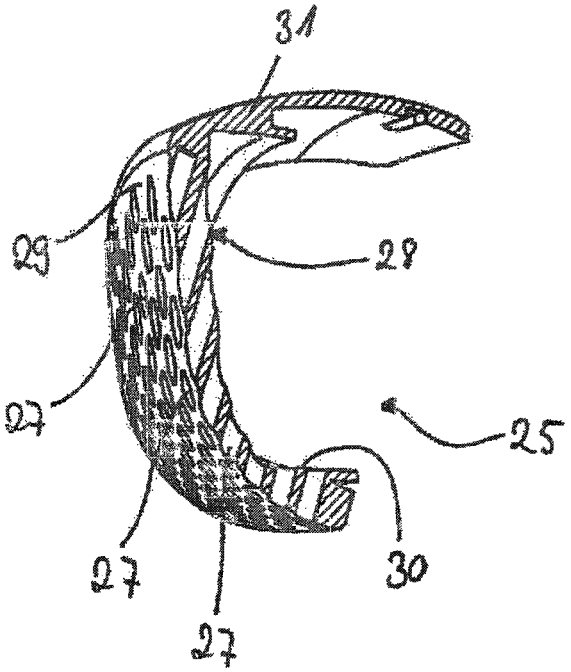
Figure 2G:
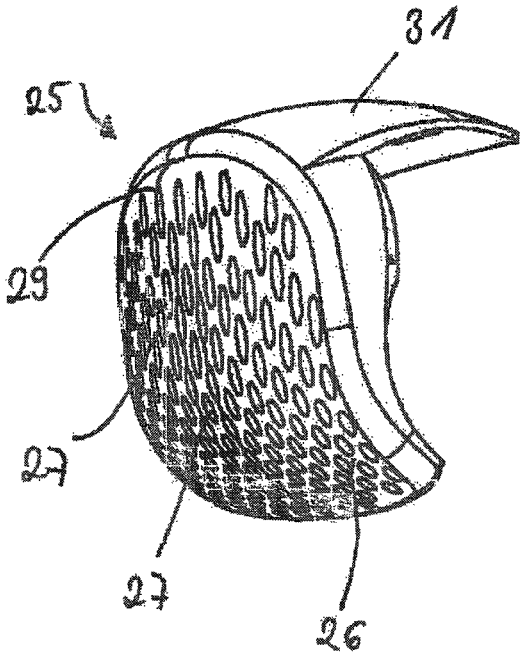
Figure 2H:
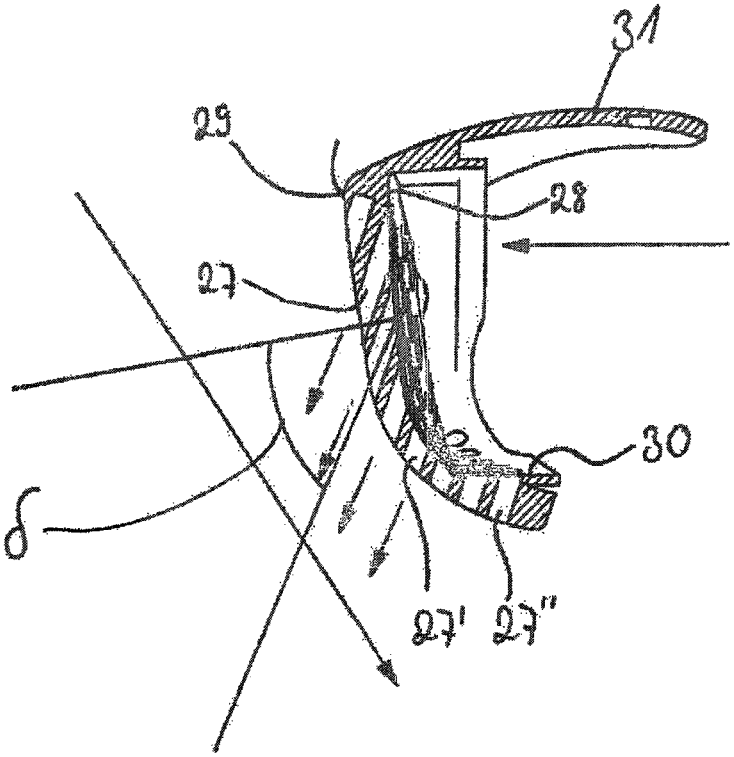

A mouthpiece system 20 is illustrated in FIGS. 2*a*-2*c*. This mouthpiece system 20 comprises a mouthpiece 21, a system housing 22, an exhalation valve 23, and an air outlet opening 24, with the air outlet opening being covered by a diffusor extension 25 comprising a diffusor plate 26, and the diffusor plate 26 comprising a plurality of openings 27.

The air outlet opening accordingly defines the intermediate space between the exhalation valve 23 and the diffusor plate 26. The diffusor plate has an inner surface 28 facing the exhalation valve 23, and an outer surface 29 facing away from the exhalation valve 23. The openings 27 in the diffusor plate 26 extend from the inner surface 28 to the outer surface 29 at an angle δ of 60° to 76°. In the illustrated sectional drawings, the openings 27 accordingly extend from the mouth obliquely downward in the direction of the chin.

Thus, air bubbles are not created in front of the swimmer's face. The emitted air is discharged toward the chin or neck. The described angle δ may be adaptable to the swimmer's lung volume and/or capacity and/or preferences. The exhaled air flows along the arrow directions illustrated in FIG. 2*h*.

As can be seen from FIGS. 2*b*-2*h*, the diffusor plate 26 and/or the diffusor extension 25 may be mounted on the system housing 22 to be exchangeable, in particular by means of latching and/or snap connections. In the illustrated example, the openings 27 of the diffusor plate which is arched (see FIG. 2*h* in this respect) have opening axes that extend in parallel to one another.

The opening 27 representing the first opening as seen from the top, extends in parallel to a central opening 27' and in parallel to the last opening 27" which is formed in the bottom area 30 of diffusor plate 26. The openings (27") in the diffusor plate's bottom area 30 have a different angle so that the parallelism of the openings or opening axes may be established. Together with a fastening flange 31, the diffusor plate 26 forms the diffusor extension 25. Diffusor extension 25 may be fitted on top of the system housing 22.

In the present example, the system housing 22 has two opposing lateral openings 32, in each of which a snorkeling tube 40 is mounted to be rotatable. To this end, snorkeling tube 40 may have a flange surface preferably formed of a circular ring or elliptical shape, with the flange surface (not represented) being arranged to be rotatable on an inner surface delimiting the lateral opening 32.

It is moreover shown in FIG. 2*c* that the mouthpiece 21 may be arranged on the system housing 22 such that an imaginary prolongation through a dental support plate 82 of mouthpiece 21 describes an angle σ of 60 to 80°, in particular 65 to 75°, in particular 70°, with the extensions of the openings 27 formed in diffusor plate 26.

By means of the mouthpiece system 20 according to the invention it is possible for a swimmer to be able to perform a flip turn while water cannot enter the mouthpiece system 20. This is possible primarily because of the openings 27 that extend obliquely.

A snorkeling tube 40 according to the invention is furthermore shown in FIGS. 2*a* and 2*b*. Snorkeling tube 40 comprises a first portion 91 facing the mouthpiece 21 or mouthpiece system 20, and a second portion 92 associated to an air inlet opening or the valve system 10.

It is obvious from FIGS. 2*a* and 2*b* that the snorkeling tube 40 is bent several times. When viewing the snorkeling tube 40 in the breathing aid's state of use in a side view as shown in FIG. 2*b*, it can be seen that the second portion 92 is angled from the first portion 91. The second portion 92 is angled in particular in the direction of the mouthpiece's 21 or mouthpiece system's 20 blow-out direction AR. The angle φ describing the first portion's 92 angularity from the first portion 91 is in particular 12 to 18°.

When viewing the snorkeling tube 40 in the breathing aid's state of use in a top view as shown in FIG. 2*a*, the first portion 91 and the second portion 92 are bent such that a convex bending is given corresponding approximately to a swimmer's head shape. It is also obvious from this view that the first portion 91 has a linear longitudinal extension LE1 corresponding to at least 1.8 times, in particular at least 2 times the dimension of the linear longitudinal extension LE2 of the second portion 92. The linear longitudinal extensions LE1 and LE2 thus describe the linear distance between the respective ends of first portion 91 and second portion 92, respectively.

It is furthermore apparent in FIG. 2*a* that the bending radius r1 in the first portion 91 is formed as a convex bending radius r1 which may formed to be different as compared to the bending radius r2 of the second portion 92. In the second portion 92, a step may be formed on the outer surface in such a manner that a cap-like housing, in particular the illustrated valve housing 1 can be slid upon the second portion 92 at least in sections. In the area of the step, the snorkeling tube housing as seen in cross-section may have a reduced outer circumference as compared to the rest of the second portion's 92 snorkeling tube housing.

A snorkeling tube 40 for a breathing aid for swimmers is illustrated in FIGS. 3*a* and 3*b*, with a number of spaced apart weakening contours 41 being formed on a snorkeling tube section 44 facing an air inlet opening 43. The snorkeling tube length $L_s$ is formed to be adaptable by severing one of the weakening contours 41.

The weakening contours 41 may be formed as notch-like cuts, for example. Furthermore, it is conceivable for the weakening contours 41 to have a number of spaced apart recesses in the material. In the illustrated example, the weakening contours 41 extend in a circular form over the entire circumference around the snorkeling tube section 44. The four weakening contours 41 are mutually arranged at the same distance. Depending on the head size and, for instance, the size of the valve housing 1 of a valve system 10, a weakening contour 41 may be selectively severed. The severing may be performed by kinking, for example. It is furthermore conceivable that the weakening contour 41 can be severed by rotating. Also, the use of tools, such as, for instance, scissors, a knife or a saw is possible.

Moreover, a plurality of markings 42 is formed on the snorkeling tube section 44, with the snorkeling tube length $L_s$ being adjustable by means of the markings 42. The markings 42 are formed on the weakening contours 41 at least in sections.

The snorkeling tube end 9 facing the air inlet opening 43 may be formed on the outer surface such that a valve system 10, in particular a valve system 10 according to the invention described above can be attached to the snorkeling tube end 9. The cross-sections of the snorkeling tube end 9 and the valve housing 1 may be adapted to one another, for example.

Figure 4A:
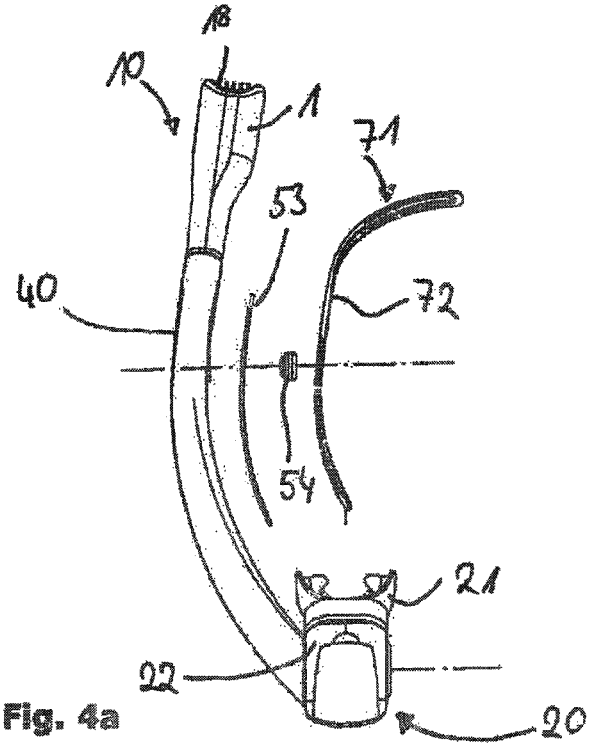
Figure 4B:
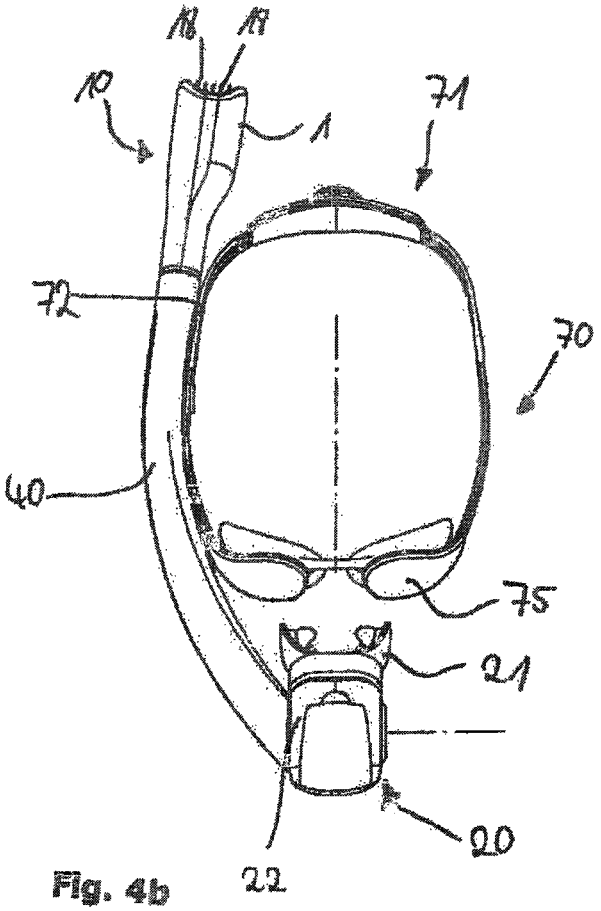
Figure 4C:
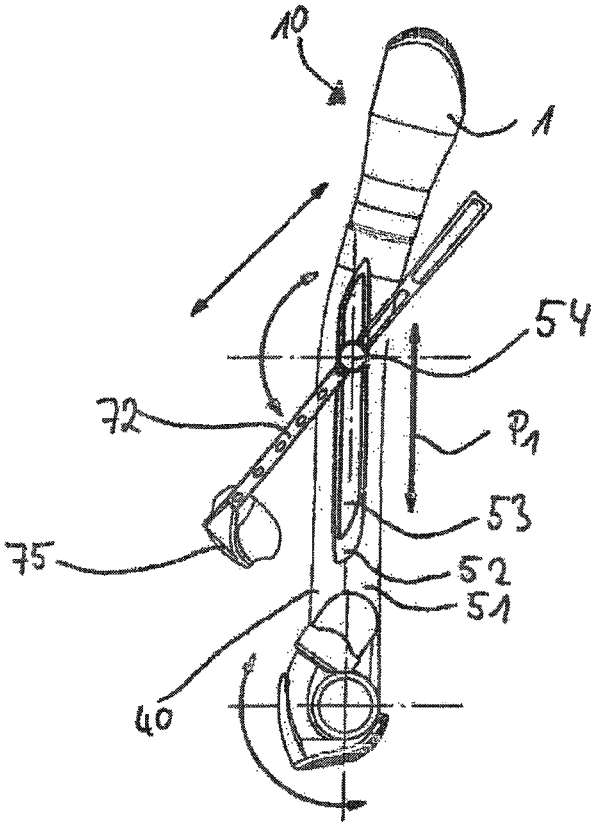
Figure 4D:
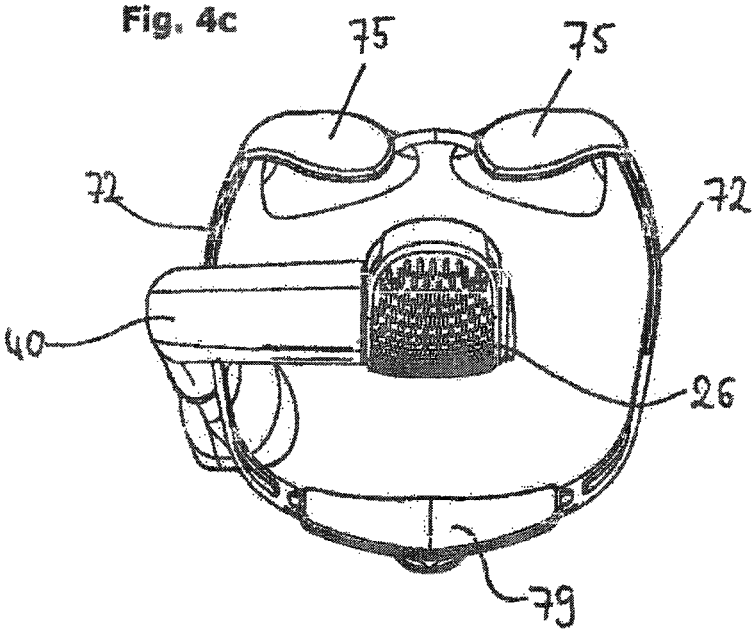
Figure 4E:
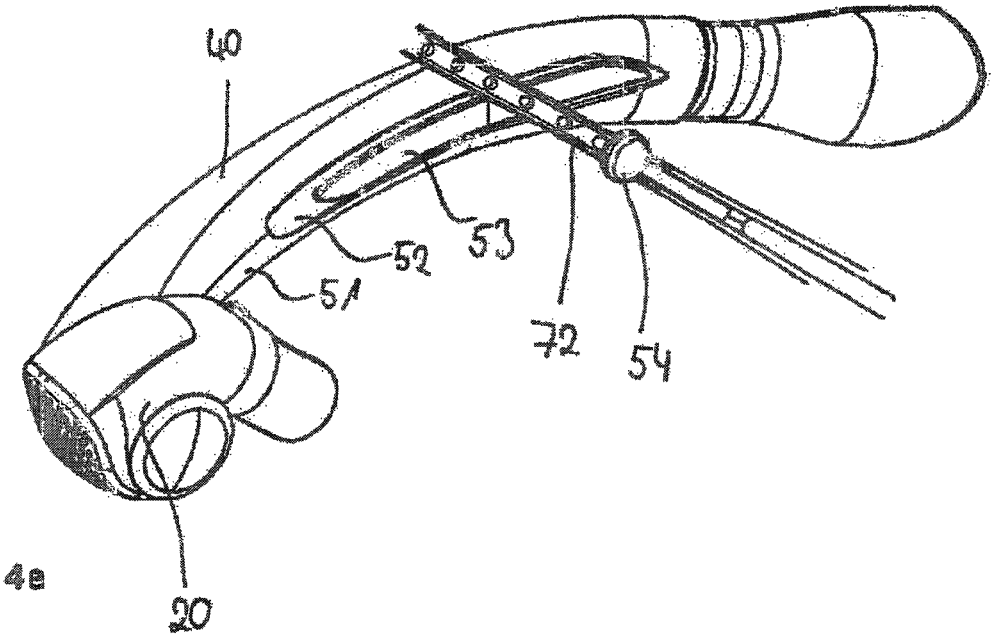

A further snorkeling tube 40 according to the invention is formed in FIGS. 4*a*-4*e*. As can be seen in FIGS. 4*c* and 4*e*, a tube area section 51 facing the head of a swimmer has a depression 52, with a magnetic element 53 being inserted and fixed in the depression 52. The fixing of the magnetic element 53 in the depression 52 may be performed by gluing, for example.

The depression 52 represents an indentation or stamping which constitutes such a form that a magnetic element 53 of an elongated form may be inserted in the depression 52. Preferably, the magnetic element's 53 thickness is formed to be smaller or equal to the depression's 52 depth so that the magnetic element 53 will nor protrude beyond the tube area section 51.

The magnetic element 53 cooperates with a fastening magnet 54 of swimming goggles 70. The fastening magnet 54 may be displaced upward or downward along the arrow P1 so that the snorkeling tube's 40 position is variable in relation to the swimming goggles 70 situated on a head, or to the head attachment system 71 of the swimming goggles 70. Of course, the magnetic element 53 may also cooperate with a fastening magnet of diving goggles or a head band or a head attachment system of a breathing aid. In the illustrated example, the snorkeling tube 40 is part of a breathing aid comprising a mouthpiece system 20 and a valve system 10.

A breathing aid 60 for swimmers is illustrated in FIG. 5, with the breathing aid 60 comprising two snorkeling tubes 40, a mouthpiece system 20, and a head attachment system 61. The head attachment system 61 has two elongated fastening elements 62, each having a first end portion 63 and a second end portion 64, wherein in each case the first end portion 63 of a fastening element 62 is fastened or may be fastened to each snorkeling tube 40, with the positions of the second end portions 64 of the two fastening elements 62 being mutually adjustable by a latching system.

The latching system may be a system comprised of rack-like and gear-like elements, with the rack-like elements being formed in conjunction with the fastening elements 62 and mutually arranged to be mobile. Rack-like elements are in particular formed in the second end portions 64.

The snorkeling tubes 40 are mounted to be rotatable in the mouthpiece system's 20 system housing 22. Both snorkeling tubes have a grove-like depression 66 on tube area sections 65 facing the head of a swimmer, with the first end portion 63 being in each case positionable in the depression 66 in a rail-like manner. In other words, the first end portion 63 may be displaced in the direction toward the mouthpiece system 20 or in the direction toward the valve system 10 in a rail-like manner.

The fastening element's 62 first end portion 63 has a plurality of recesses 67 in the form of holes, with the illustrated first end portion 63 being fastened in the depression 66 by a fastening means 68 that may be introduced into one of the recesses 67. The fastening means 68 may be formed as a rivet-like fastening means which is fixed in the depression 66. It is also conceivable for the fastening means to be formed separately and detached from the depression 66, wherein the depression 66 also needs to have a recess in this case so that the first end portion 63 can be fastened in the depression 66. The latching system, that is not shown in greater detail, has a turning knob 69 in FIG. 5. Moreover, in the area of the latching system, in particular in the area of the turning knob 69, a head contact plate 80 is formed on the side of the head attachment system 61 facing the head of a swimmer. The head contact plate 80 is formed to be arched. Pressure forces acting upon the head are distributed in a two-dimensional manner by means of such a head contact plate 80. It moreover prevents, for instance, hair from getting wound around the turning knob 69.

The single method steps of a method according to the invention for putting on a breathing aid 60 are illustrated in FIGS. 6*a*-6*c*. As shown in FIG. 6*a*, a mouthpiece 21 of a mouthpiece system 20 is first inserted into the swimmer's mouth. The mouthpiece 21 in this case usually comprises a dental support plate 82 or bite tray so that the mouthpiece 21 can be fixed in the mouth.

Subsequently, the two snorkeling tubes 40 are pivoted. The pivoting of the snorkeling tubes 40 is done in an arch as shown in FIG. 6*b*. Accordingly, the snorkeling tubes are pivoted from the front to the rear. The pivoting of the snorkeling tubes 40 is performed with the mouthpiece 21 further remaining in the swimmer's mouth.

After the two snorkeling tubes 40 have been pivoted completely, the breathing aid 60 is fastened on the swimmer's head 81 by means of a head attachment system 61. In the illustrated example, the fastening of the head attachment system 61 is performed by turning a turning knob 69.

The snorkeling tubes 40 are pivoted such that the turning knob 69, in particular the turning knob's 69 center, is situated in relation to the dental support plate 82 on a line arranged at an angle Ω of 40°-50° to the horizontally arranged dental support plate 82.

The combination of a mouthpiece system 20 with snorkeling tubes 40 mounted therein to be rotatable, and the head attachment system 61 allows an optimum angle for the swimmer to be set with respect to the turning knob 69 or a ratchet lever, at which unpleasant traction forces on the palate and/or gingiva will not be created despite the breathing aid's 60 firm fixing on a swimmer's head 81. In a ratchet lever, the line would pass through the ratchet lever's axis of rotation, for example.

Swimming goggles 70 are illustrated in FIGS. 7*a*-7*c* in different views. The swimming goggles 70 have a head attachment system 71 with two elongated fastening elements 72, each of which having a first end portion 73 and a second end portion 74, with the first end portions 73 pointing toward the lenses 75 of the swimming goggles 70.

The second end portions' 74 position is adjustable via a latching system 76. The first end portions 73 are formed in one piece with the edge portions 77 of the lenses 75. The edge portions 77 may also be referred to as lateral lens covers or lateral frame portions.

It is furthermore conceivable for the first end portions 73 to be connected to the edge portions 77. On the side of the head attachment system 71 facing a swimmer's head, a head contact plate 79 is formed in the area of the illustrated turning knob 78. The head contact plate 79 is formed to be arched so that it can fit the swimmer's head in an ergonomic manner.

The elongated fastening elements 72 have recesses 83 of a slotted hole shape. The recesses 83 of the slotted hole shape effectuate flexibility of the fastening elements 72 so that the swimming goggles 70 can be stored in a small storage container. To this end, that part of the swimming goggles 70 comprising the head contact plate 79 may be bent in the direction of the lenses 75. Due to the recesses 83, bending portions 84 (see FIG. 7*c*) may be formed, wherein the material of the longitudinal fastening elements 72 will not be impaired and, for instance, does not break or tear off either. In the state illustrated in FIG. 7*c*, swimming goggles may be packed in smaller storage containers.

It should be noted at this point that all of the elements and components described above in conjunction with the embodiments according to FIGS. 1*a* to 7*c*, separately or in any combination, in particular the details illustrated in the drawings, are claimed as essential to the invention. The aspects according to the invention, in particular the valve system according to the invention and/or the mouthpiece system according to the invention and/or the snorkeling tubes according to the invention and/or the breathing system according to the invention may be optionally combined.

Hereinafter, further exemplary embodiments will be indicated.

EXEMPLARY EMBODIMENT 1

A snorkeling tube (40) for a breathing aid (60) for swimmers, wherein on a snorkeling tube section (44) facing an air inlet opening (43), a plurality of spaced apart weakening contours (41) is formed such that the snorkeling tube length (LS) is formed to be adaptable by severing one of the weakening contours (41).

EXEMPLARY EMBODIMENT 2

The snorkeling tube (40) according to exemplary embodiment 1, characterized in that
a plurality of spaced apart markings (42) is formed on the snorkeling tube section (44), wherein the snorkeling tube length (LS) is adjustable by means of the markings (42).

EXEMPLARY EMBODIMENT 3

The snorkeling tube (40) according to exemplary embodiment 2,
characterized in that
the markings (42) are formed on the weakening contours (41) at least in sections.

EXEMPLARY EMBODIMENT 4

The snorkeling tube (40) according to any one of exemplary embodiments 1 to 3,
characterized in that
the snorkeling tube end (9) facing an air inlet opening (43) is formed on the inner and/or outer surface such that a valve system, in particular a valve system (10) according to any one of the patent claims is fastened or can be fastened to the snorkeling tube end (9).

EXEMPLARY EMBODIMENT 5

The snorkeling tube (40) according to any one of exemplary embodiments 1 to 4,
characterized in that
at the snorkeling tube end facing away from the air inlet opening (43), a flange surface is formed to be of a preferably circular ring or elliptical ring shape.

EXEMPLARY EMBODIMENT 6

A snorkeling tube (40) for a breathing aid (60) for swimmers, wherein a tube area section (51) facing the head of a swimmer, has a depression (52), and a magnetic element (53) is inserted and fastened in the depression (52).

EXEMPLARY EMBODIMENT 7

The snorkeling tube (40) according to exemplary embodiment 6,
characterized in that
the magnetic element (53) is formed to be elongated.

EXEMPLARY EMBODIMENT 8

The snorkeling tube (40) according to exemplary embodiment 6 or 7,
characterized in that
the magnetic element (53) cooperates with a fastening magnet (54) of swimming goggles (70) or diving goggles or a head band or a head attachment system (61) of the breathing aid (60).

EXEMPLARY EMBODIMENT 9

A method for putting on a breathing aid for swimmers, in particular a breathing aid (60) according to any one of the patent claims, comprising the steps of:
inserting a mouthpiece (21) into the swimmer's mouth,
pivoting at least one snorkeling tube (40),
attaching the breathing aid (60) on the swimmer's head (81) by means of a head attachment system (61).

EXEMPLARY EMBODIMENT 10

The method according to exemplary embodiment 9,
characterized in that
at least one snorkeling tube (40) is pivoted such, and the head attachment system (61) adopts such a position on the swimmer's head (81) that a turning knob (69) and/or a ratchet lever of the head attachment system (61) is/are situated in relation to a dental support plate (82) of the mouthpiece (21) on a line arranged at an angle (Ω) of 30°-60°, in particular of 40°-50°, in particular of 45° to the dental support plate (82).

EXEMPLARY EMBODIMENT 11

The method according to exemplary embodiment 9 or 10,
characterized in that
the fastening of the head attachment system (61) is performed by turning a/the turning knob (69) or by actuating a/the ratchet lever.

EXEMPLARY EMBODIMENT 12

Swimming and/or diving goggles (70) with a head attachment system (71) having two elongated fastening elements (72), each having a first end portion (73) and a second end portion (74), and the first end portion (73) pointing toward the lenses (75) or lens of the swimming and/or diving goggles (70), with the positions of the second end portions (74) being mutually adjustable by a latching system.

EXEMPLARY EMBODIMENT 13

Swimming and/or diving goggles (70) according to exemplary embodiment 12,
characterized in that
the latching system comprises a turning knob (78) and/or a ratchet lever.

EXEMPLARY EMBODIMENT 14

Swimming and/or diving goggles (70) according to exemplary embodiment 12 or 13,
characterized in that
the first end portions (73) of the fastening elements (72) each are connected to an edge portion (77) of the lenses (75) or lens.

EXEMPLARY EMBODIMENT 15

Swimming and/or diving goggles (70) according to exemplary embodiment 12 or 13,
characterized in that
the first end portions (73) of the fastening elements (72) and the edge portions (77) of the lenses (75) or lens are formed to be of one piece.

EXEMPLARY EMBODIMENT 16

Swimming and/or diving goggles (70) according to any one of exemplary embodiments 12 to 15,
characterized in that
on the side of the head attachment system (71) facing the head of a swimmer, in particular in the area of a/the turning knob (78) or a/the ratchet lever, a head contact plate (79) is formed.

EXEMPLARY EMBODIMENT 17

Swimming and/or diving goggles (70) according to any one of exemplary embodiments 12 to 16,
characterized in that
at least one elongated fastening element (72) has a recess (83) which is preferably formed in the shape of a slotted hole.

LIST OF REFERENCE NUMERALS

1 valve housing
2 valve diaphragm
3 contacting section
4 first end
5 fastening element
6 second end
7 air inlet opening
8 opening
9 snorkeling tube end
10 valve system
11, 11' valve diaphragm section
12 inner surface
13 boundary surface
14 end portion of valve diaphragm
15 clamping portion
16 beveled surface
17 portion of valve diaphragm
18 strut-like element
19 end portion of valve housing
20 mouthpiece system
21 mouthpiece
22 system housing
23 exhalation valve
24 air outlet opening
25 diffusor extension
26 diffusor plate
27, 27', 27" opening
28 inner surface
29 outer surface
30 bottom area of diffusor plate
31 fastening flange
32 lateral opening
33 strut-like element
34 strut-like element
35 grid-like cover
40 snorkeling tube
41 weakening contour
42 marking
42 air inlet opening
44 snorkeling tube section
45, 45' valve housing section
46 section
47 stop edge
48 end edge
49 recess
51 tube area section
52 depression
53 magnetic element
54 fastening magnet
55 air-permeable cover
56 circular opening
56' duct
57 indentation
60 breathing aid
61 head attachment system
62 elongated fastening element
63 first end portion
64 second end portion
65 tube area section
66 depression
67 recess
68 fastening means
69 turning knob
70 swimming goggles
71 head attachment system
72 fastening element
73 first end portion
74 second end portion
75 lens
76 latching system
77 edge portion
78 turning knob
79 head contacting plate
80 head contacting plate
81 head
82 dental support plate
83 recess
84 bending portion
85, 85' end cap
86 end surface
87 cross member
88 end edge
89 opening
90 guiding element
91 first portion
92 second portion
$\alpha$, $\alpha'$ angle between valve diaphragm sections, in particular between the valve diaphragm's end portions
$\beta$ angle between the inner surface and boundary surface
$\varepsilon$ angle opening of cross members of a lamella-like arrangement
$\varphi$ angle of snorkeling tube with respect to the angled second portion
$\sigma$ angle between the dental support plate and openings of the diffusor plate
$\gamma$ angle of beveled surface
$\delta$ angle of diffusor plate opening
$\Omega$ angle of turning knob position
AR blow-out direction
L longitudinal axis
$Q_1$ inner cross-section
$Q_2$ outer cross-section
$L_s$ snorkeling tube length
P1 arrow
LE1 linear longitudinal extension of first portion
L2 linear longitudinal extension of second portion
r1 bending radius of first portion
r2 bending radius of second portion

The invention claimed is:

1. A mouthpiece system (20) for a breathing aid (60) for swimmers, comprising a mouthpiece (21), a system housing (22), an exhalation valve (23) through which exhaled air flows, and an air outlet opening (24), with the air outlet opening (24) being covered by a diffusor extension (25) comprising a diffusor plate (26), and the diffusor plate (26) having a plurality of circular and/or oval and/or elliptical openings (27), each of the openings (27) being formed as one of a capillary and a duct wherein the diffusor plate (26) has an inner surface (28) facing the exhalation valve (23), and an outer surface (29) facing away from the exhalation valve (23), with the openings (27) in the diffusor plate (26) extending transversely from the inner surface (28) to the outer surface (29); and wherein each of the openings (27) is disposed in the same direction at an angle (δ) offset 5°-89° from an axis normal to the inner surface (28) of the diffusor plate (26) so that, when the mouthpiece system (20) is worn by the swimmer, the exhaled air is directed angularly downwardly away from the swimmer's face.

2. The mouthpiece system (20) according to claim 1, characterized in that the mouthpiece (21) is firmly locked onto the system housing (22).

3. The mouthpiece system (20) according to claim 1, characterized in that each of the openings (27) is disposed in the same direction at an angle (δ) offset 40°-85° from an axis normal to the inner surface (28) of the diffusor plate (26) so that, when the mouthpiece system (20) is worn by the swimmer, the exhaled air is directed angularly downwardly away from the swimmer's face.

4. The mouthpiece system (20) according to claim 3, characterized in that the angle (δ) is adaptable to the swimmer.

5. The mouthpiece system (20) according to claim 1, characterized in that the diffusor plate (26) and/or the diffusor extension (25) is/are mounted on the system housing (22) to be exchangeable.

6. The mouthpiece system (20) according to claim 1, characterized in that the system housing (21) has two opposing lateral openings (32), in each of which a snorkeling tube (40) is mounted to be rotatable.

7. A breathing aid (60) for swimmers, comprising at least two snorkeling tubes (40), a mouthpiece system (20) according to claim 1, and a head attachment system (61) with two elongated fastening elements (62), each comprising a first end portion (63) and a second end portion (64), wherein in each case the first end portion (63) of one fastening element (62) is fastened or can be fastened to each snorkeling tube (40), with the position of the second end portions (62) being mutually adjustable by a latching system.

8. The breathing aid (60) according to claim 7, characterized in that the snorkeling tubes (40) are mounted to be rotatable in a system housing (22) of the mouthpiece system (20).

9. The breathing aid (60) according to claim 7, characterized in that a snorkeling tube (40) has a groove-shaped depression (66) on a tube area section (65) facing the head of a swimmer, with the first end portion (63) of a fastening element (62) being positionable in the depression (66) in a rail-like manner.

10. The breathing aid (60) according to claim 9, characterized in that the first end portion (63) of a fastening element (62) has a plurality of recesses (67) and the first end portion (63) is fastened or can be fastened in the depression (66) by a fastening means (68) that can be introduced into at least one of the recesses (67).

11. The breathing aid (60) according to claim 7, characterized in that the latching system comprises a turning knob (69) and/or a ratchet lever.

12. The breathing aid (60) according to claim 7, characterized in that on the side of the head attachment system (61) facing the head of a swimmer, a head contact plate (80) is formed in the area of the latching system.

13. The breathing aid (60) according to claim 7, characterized in that in the breathing aid's (60) state of use, the turning knob (69) and/or the ratchet lever is/are situated in relation to a dental support plate (82) of a mouthpiece (21) on a line arranged at an angle (Ω) of 30°-60° to the dental support plate (82).

* * * * *